US005562060A

United States Patent [19]

Price et al.

[11] Patent Number: 5,562,060

[45] Date of Patent: Oct. 8, 1996

[54] WAIST BAND ATTACHMENT SYSTEM

[75] Inventors: Elvin C. Price, Dacula; Preston B. Dasher, Lawrenceville; Gerald C. Valentine, Buford, all of Ga.

[73] Assignee: Atlanta Attachment Company, Lawrenceville, Ga.

[21] Appl. No.: 503,518

[22] Filed: Jul. 18, 1995

Related U.S. Application Data

[63] Continuation-in-part of Ser. No. 311,921, Sep. 26, 1994, Pat. No. 5,522,332, which is a continuation-in-part of Ser. No. 131,131, Oct. 4, 1993, Pat. No. 5,437,238.

[51] Int. Cl.[6] ..... D05B 21/00

[52] U.S. Cl. ..... 112/470.29; 112/272; 112/475.09

[58] Field of Search ..... 112/470.29, 470.31, 112/475.07, 475.09, 475.13, 475.03, 475.05, 153, 305, 322, 306, 271, 272, 273, 277

[56] References Cited

U.S. PATENT DOCUMENTS

| | | | |
|---|---|---|---|
| 4,046,087 | 9/1977 | Manetti . | |
| 4,053,967 | 10/1977 | Mair | 26/98 |
| 4,265,187 | 5/1981 | Torre | 112/121 |
| 4,473,017 | 9/1984 | Letard et al. | 112/141 |
| 4,481,507 | 11/1984 | Takiguchi et al. | 112/277 X |
| 4,484,532 | 11/1984 | Norz | 112/2 |
| 4,681,051 | 7/1987 | Kirch et al. | 112/306 |
| 4,682,553 | 7/1987 | Bachmann et al. | 112/306 X |
| 4,928,610 | 5/1990 | Akatsu | 112/153 |
| 5,188,047 | 2/1993 | Rohr et al. | 112/272 X |
| 5,251,557 | 10/1993 | Rohr | 112/306 |
| 5,269,239 | 12/1993 | Adamski, Jr. et al. | 112/63 X |
| 5,269,257 | 12/1993 | Yamazaki . | |
| 5,370,072 | 12/1994 | Adamski, Jr. | 112/306 X |
| 5,437,238 | 8/1995 | Price et al. | 112/470 |

FOREIGN PATENT DOCUMENTS

| | | |
|---|---|---|
| 5811471 | 7/1981 | Japan . |
| 58-11471 | 1/1983 | Japan . |

*Primary Examiner*—Paul C. Lewis
*Attorney, Agent, or Firm*—Hopkins & Thomas

[57] ABSTRACT

A waist band (18) is placed in straddling relationship about spindles (11–14). The waist edge (24) of the garment body (19) is telescoped about the waist band (18), also in straddling relationship about the spindles (11–14). The garment parts are advanced by the rotation of the spindles (11–14) past a sewing needle (17) that forms a line of stitching at the aligned edges of the shirt body and waist band. In the meantime, the end spindles (11 and 13 and 14) move longitudinally along the sewing path to adjust the position of the waist band in response to the position of the folded edges (22, 23) of the waist band (18) as detected by band sensor 128, and the star wheels (119) engage and urge the waist band (18) and the garment body (19) toward or away from the sewing path (16) as controlled by band and body edge sensors (112, 129). When the previously sewn edges of the garment parts begin to return to the sewing machine (36), one of the spindles (13) moves laterally so as to stretch the garment parts more, so as to remove any bunching of the waist edge (24) of the garment body (19) at the sewing needle (17) and presser foot (39), to avoid forming a wrinkle in the garment body (19) at the end of the line of the stitching (29).

42 Claims, 13 Drawing Sheets

Function (1) Guide tongue assembly 95, edge guide assembly 115, and lever switch 136 move out to operative position (2) Left spindle 11 moves left to stretch garment (3) Puller roll 45 moves down and rotates to pull garment about spindles (4) Initial jog to align edges (5) Upper edge guide unit 117 controls position of shirt edge; and Lower edge guide unit 116 controls position of band edge (6) Decurler air on (7) Edge ejector 51 in guide position (8) Presser foot 32 moves down and stictches 26 being formed (9) Lower right spindle moves to stretch garment

(10) Lever switch 136 engaged by stitches 26

(11) Lever switch 136 retracted edge ejector 51 begins to eject garment progressively

(12) Presser foot raised to initial position and tension on needle thread released as sewing machine sews off garment and sews thread chain

(13) Thread chain severed

(14) Stacker removes work product

Cycle Time

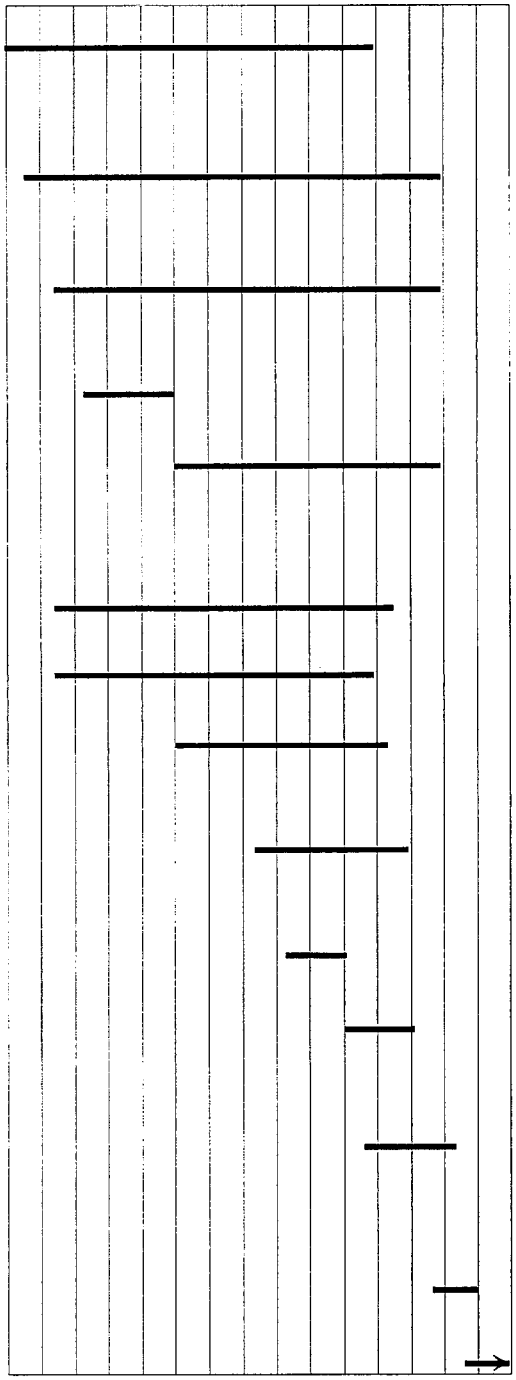

FIG. 17

WAIST BAND ATTACHMENT SYSTEM

CROSS REFERENCE TO RELATED APPLICATION

This is a continuation-in-part of U.S. patent application Ser. No. 08/311,921, filed Sep. 26, 1994 now U.S. Pat. No. 5,522,332, which is a continuation-in-part of U.S. patent application Ser. No. 08/131,131 filed Oct. 4, 1993 now U.S. Pat. No. 5,437,238.

FIELD OF THE INVENTION

This invention relates to a method and apparatus for attaching a continuous loop waist band to the continuous waist edge of a garment such as a tubular shirt body or a pair of pants. The waist band material is attached to the waist edge of the garment by matching an edge of the waist band with the waist edge of the garment, stretching both garment parts to substantially the same breadth and advancing the matched edges through a sewing machine.

BACKGROUND OF THE INVENTION

In the production of garments in an industrial setting in which batches of garment parts are delivered to work stations where the garment parts are connected together, it is important that the sewing equipment provided to the worker be fast and efficient in its operation, but also it is important that the garment parts can be expediently loaded on the equipment. Further, it is highly desirable that once the garment parts have been loaded in position and the equipment is placed in operation that the worker be able to momentarily leave the equipment while the equipment continues to operate. This enables the worker to operate more than one machine and to gather more garment parts and match them together for presentation to another duplicate machine for its next cycle of operation.

In the production of stretchable garments, such as sweat suits having a shirt body made of fleece and a waist band of stretchable knit material, it is sometimes difficult for the worker or the equipment to accurately control the material as it is being fed to the sewing machine. For example, when the knitted waist band of a sweat suit is to be connected to the waist edge of the fleece shirt body, the more stretchable waist band may be of smaller breadth than the waist edge of the shirt body when both garments are relaxed. When the waist band and the waist edge of the shirt body are being guided to the sewing machine, the waist band usually must be stretched more than the waist edge of the shirt body in order that they are properly matched in breadth as they are sewn together. Further, the edge of the fleece material usually tends to curl as it is stretched, which requires the curled edges to be flattened before they are presented to the sewing needle of the sewing machine. Also, some of the waist bands are cut to improper widths or are cut with non-uniform widths which, when sewn to the shirt body, etc., ultimately causes the garment to be unaccepted.

Because of these inherent problems in presenting the stretchable waist band and shirt or pants body materials to the sewing needles of the sewing machine and operating the equipment, machine operators have been required to develop relatively high skill in presenting the work product to the sewing machine. As a part of the presentation of the work product to the sewing machine, the operators also typically have had to stretch the waist bands, as by pulling the waist bands laterally, to match the waist edges of the garments prior to presenting the waist band materials to the sewing machine. Such a stretching motion becomes extremely tiresome for the operator over the course of a work shift during which 3000–4000 articles are finished. As a result, work productivity is slowed and there is a greater chance of injury occurring.

Further, the presentation of the work product to and the sewing of the work product by the sewing machine requires substantially full attention of the operator during at least some of the cycle of operation of the sewing machine to watch for jamming and the formation of wrinkles about the waist band and waist edge of the garment. This results in the operator not having enough time during the cycle of operation of the sewing machine to retrieve and assemble the next garment parts that are to be presented to the sewing machine or to operate two machines simultaneously.

Accordingly, it can be seen that a need exists for a sewing machine assembly for sewing waist band materials to the waist edges of garments that is easy to load and operate without requiring the complete and exacting attention of the operator so as to enable the operator to perform additional tasks and/or operate additional machines at the same time.

SUMMARY OF THE INVENTION

Briefly described, the present invention comprises a method and apparatus for matching the edges of a loop waist band with the waist edge of a garment such as a shirt body or pair of slacks, stretching the waist band and the garment waist edge until their breadths are matched, and advancing the matched edges along the sewing path of the sewing machine prior to sewing for a preliminary alignment run until the edges are automatically aligned in the sewing path of the sewing head and for removing any curl in the matched edges. Further, when the sewing cycle is almost completed, the waist band and garment body are further stretched to eliminate any tendency of the presser foot of the sewing machine to form a pleat or wrinkle in the waist edge of the finished garment at the end of the sewing cycle.

A series of rotatable guide spindles are mounted to the work table of the sewing machine and project out parallel to one another at the sewing machine toward the operator's position. Each of the guide spindles has an elongated, generally cylindrical body, having rounded distal ends projecting laterally from the sewing path. The spindles are initially arranged in a small cluster and the garment parts are placed about all of the spindles. When the system is activated, the spindles spread apart to stretch the garment parts to matching breadths. The spindles tend to hold the waist band and the waist edge of the garment when stretched as the spindles are rotated and the garment parts are moved progressively past the sewing needles of the sewing machine.

The operator folds the waist band so that its edges are aligned and then places the waist band in straddling relationship about the spindles with the edges of the waist band matched and being positioned in the sewing path of the sewing machine. When the operator places the waist band about the spindles, the edge of the waist band is detected by a band sensor. The band sensor is a photocell or similar sensing means mounted along the sewing path in a position to detect the edges of the waist band. In response to the waist band moving into the sewing path and triggering the edge sensor, a first spindle is moved longitudinally with respect to the sewing path away from the other spindles to expand the waist band to an initial stretched position.

A guide tongue assembly is moveable into the sewing path upstream of the sewing machine in response to the waist band being placed in its position about the spindles and detected by the bond sensor. The guide tongue assembly is moved laterally toward the sewing path into a position extending over the waist band substantially simultaneously with the movement with the first spindle away from the other spindles. The guide tongue assembly includes one idler wheel facing upwardly and another idler wheel facing downwardly.

The waist of the garment body is then placed in overlying relation about the waist band and about the spindles, and the switch to begin the sewing cycle is closed by the operator. In response to the closing of the switch by the operator to initiate the sewing cycle, the spindles are further separated from one another to expand the waist edge of the garment body and the waist band. As a result, both the waist band and the waist edge of the garment body are under tension and the breadths of the matched edges of the garment parts are substantially the same as they pass through the sewing machine.

In further response the closing of the switch by the operator prior to the start of a sewing operation, an edge guide system is moved into engagement with the garment body and waist band for controlling the positions of the edges of the garment body and the waist band as the parts advance toward the sewing needles. The edge guide system includes upper and lower edge guide assemblies, each including a toothed star wheel received in engagement with an idler wheel of the guide tongue assembly, with the garment body and waist band being engaged between the toothed star wheels of the edge guide assemblies and the idler wheels of the guide tongue assembly.

A decurler is mounted to the guide tongue assembly and includes air nozzles facing the sewing path. The air nozzles direct streams of air across the sewing path, directed at the edges of the waist band and garment body. The flow of air across the edges of the waist band and garment body removes any curl in the edges of the garment parts as the garment parts approach the sewing machine.

At the beginning of a sewing cycle, the garment parts are allowed to advance along the sewing path at a distance sufficient to allow the decurled edges of the garment parts to move from the decurler to the sewing machine needles before the sewing machine is activated. This assures that the edges of the garment parts will be flattened before they are sewn together. Upon the completion of the sewing operation, the guide tongue assembly is retracted outwardly out of the sewing path and thus out of the way of the previously sewn matched edges of the garment parts return to the sewing needles and the finished garment is removed from the apparatus.

Sensing means are mounted adjacent the sewing path and are connected to reversible step motors for the upper and lower edge guide assemblies. The sensing means includes a band edge sensor mounted to the guide tongue assembly, facing the path of the fold of the band and a body waist edge sensor facing path of the edge of the garment body. Each sensor typically is a photo-cell type sensor. The sensors detect the presence or absence of the folded edge of the waist band and the edge of the garment body, and in response to the sensing of the edges signal the motors to rotate the star wheels of the upper and lower edge guide assemblies. The star wheels are rotated in a reciprocal fashion, clockwise and counterclockwise, depending upon the position of the edges of the waist band and garment body. The star wheels thus continually urge the edges of the garment parts back and forth across the sewing path to maintain the edges of the garment parts in a matched, substantially aligned condition as the edges of the garment parts are moved toward the sewing needles.

After the sewing cycle has been completed and the entire lengths of the edges of the waist band and shirt body have been sewn together, an ejector progressively pushes the matched and now sewn edges of the garment parts laterally out of the sewing path. At the same time, the presser foot of the sewing machine is raised slightly, approximately ⅛ inch to enable the garment to be urged out from under the needle. The garment continues its forward movement along the sewing path as it is progressively moved, by the ejector, out of engagement with the needles until the point where the stitching exits or "sews off" the garment and is located in the proximity of the vacuum trimmer of the sewing machine. The sewing machine, however, continues to sew and produce a thread chain extending from the point where the stitching is sewn off of the garment until the thread chain is severed.

At the same time, when the ejector is actuated, a tension opener is engaged to remove the tension from the needle thread. The tension opener generally comprises an air cylinder to which a push rod is connected. As the air cylinder is actuated, the push rod is urged between the tension plates of the needle tension assembly, spreading the tension plates and thus releasing the tension on the needle thread. As a result, the tensions of the needle and looper threads of the thread chain extending from the garment are substantially balanced and are approximately equal in length. Equalizing the lengths of the needle and looper threads reduces the chances that the threads of the thread chain will fray and pull apart, which would require an additional processing step to trim the chain to acceptable standards, and enables a smooth transition to be formed in the stitching as the sewing machine sews off the garment.

A stacker is positioned adjacent the spindles and provides a movable supply frame for supporting a supply of unfinished garment bodies at the worker's station, and an accumulation frame for receiving the finished garments. A wiper bar flips each garment off the spindles and over the accumulation frame upon the completion of a sewing operation. Clamp bars mounted to the supply and accumulation frames are moved into engagement with both the supply frame and the accumulation frame simultaneously with the removal of the finished garments to hold the stacks of unfinished garment bodies and finished garments on the supply and accumulation frames.

Therefore, it is an object of this invention to provide an improved method and apparatus for attaching a continuous loop waist band to the continuous waist edge of an approximately tubular body garment such as a tubular shirt body, in which the waist band and shirt body can be presented to the sewing machine by the worker, and the sewing function can commence and continue until completed while the worker is free to perform other functions.

Another object of this invention is to provide an improved waist band attachment system for a sewing machine which functions to feed and decurl automatically the matched edges of a waist band and the waist edge of a tubular shirt body of a sweat suit or similar garment made of stretchable materials as the garment parts move along the sewing path of the sewing machine.

Another object of this invention is to provide an improved set of guide spindles for maintaining the edges of stretchable garment parts in matched alignment while accurately guiding the matched edges of the garment parts along the sewing path of a sewing machine.

Another object of this invention is to provide a method an apparatus for attaching a stretchable waist band to the body of a garment in which the tension on the needle thread is removed so that the lengths of the needle and looper threads are substantially equal so that the thread chain sewn off the garment at the end of the sewing cycle will be of an acceptable length and will be less likely to fray and separate.

Another object to this invention is to provide a system for expediently and accurately loading stretchable garment parts along the sewing path for a sewing machine which permits the garment parts to be loaded in a substantially unstretched, loose condition and which automatically stretches the garment parts to a stretched, extended position with the edges of the garment parts being matched for accurate and substantially complete attachment of the edges of the garment parts together, which does not require the garment parts to be stretched by the operator as the parts are loaded into the apparatus for sewing.

Still another object of this invention is to provide a garment support assembly mounted to a work table of a sewing machine for supporting a supply of unfinished garments and the accumulation of finished garments, which can be rapidly adjusted to accommodate different size garments and which functions to remove automatically the finished garments from the sewing machine upon the completion of a sewing operation, and which includes means for clamping and holding stacks of finished and unfinished garments during movement of the support assembly for the removal of a garment from the sewing apparatus.

Other objects, features and advantages of the present invention will become apparent upon reading the following specification, when taken in conjunction with the accompanying drawings.

BRIEF DESCRIPTION OF THE DRAWINGS

FIG. 17 is a schematic illustration of the cycle time for the major functions of the system.

DETAILED DESCRIPTION

Figure 1:
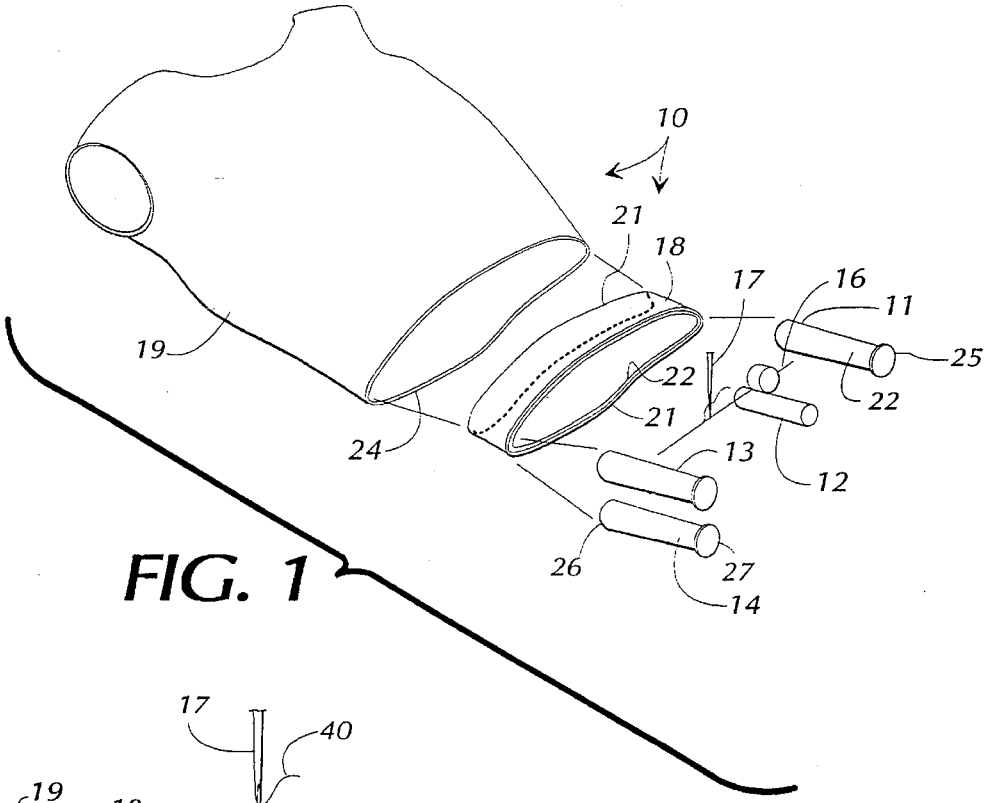
FIG. 1 is a perspective illustration of a tubular shirt body and a waist band of a garment prior to being connected together, illustrating how those parts of the garment would be placed in straddled relationship about the guide spindles of the system.
Figure 2:
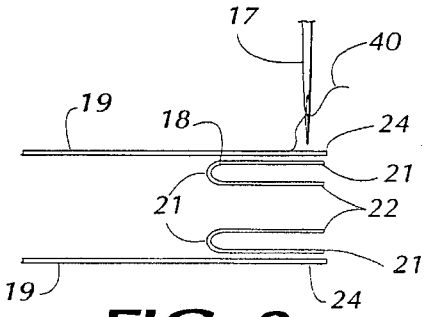
FIG. 2 is a schematic illustration of the waist band and shirt body showing how the waist band is folded and how the waist edge of the shirt body is aligned with the matched edges of the waist band.

Referring now in more detail to the drawings, in which like numerals indicate like parts throughout the several views, FIG. 1 illustrates a garment 10 placed in straddling relationship about a series of guide spindles 11, 12, 13 and 14 and moved along a substantially circular sewing path, shown by arrows 16, into engagement with a sewing needle 17 of a sewing machine. The garment is comprised of parts including a knitted continuous loop waist band 18 and garment body such as a fleece shirt body 19. As shown in FIGS. 1 and 2, the knitted waist band is folded over along its length, as shown by 21, so that its edges 22 and 23 are in an overlying aligned relationship. The edges are placed in the sewing path 16 which extends beneath a sewing needle 17, with the fold 21 of the waist band 18 facing away from the sewing needle. The shirt body 19 has a waist edge 24 that is placed in the sewing path in overlying alignment with the edges 22 and 23 of the waist band 18.

Typically, the sewing machine operator folds the waist band by hand and then places the waist band about the spindles 11–14 as indicated in FIG. 1. Spindles 11, 12, 13 and 14 each are elongated, substantially cylindrically shaped members with a rounded, tapered proximal end 26 and a distal end 27. The aligned edges 22 and 23 of the waist band 19 are moved by the sewing machine operator onto the spindles, received over the tapered proximal ends thereof and approximately in alignment with the distal ends 27 of the spindles. The spindles support and guide the waist band and shirt body along the sewing path 16 for attaching and trimming, and uniformly stretch the waist band to a predetermined width to match the waist edge of the shirt body.

Figure 3A:
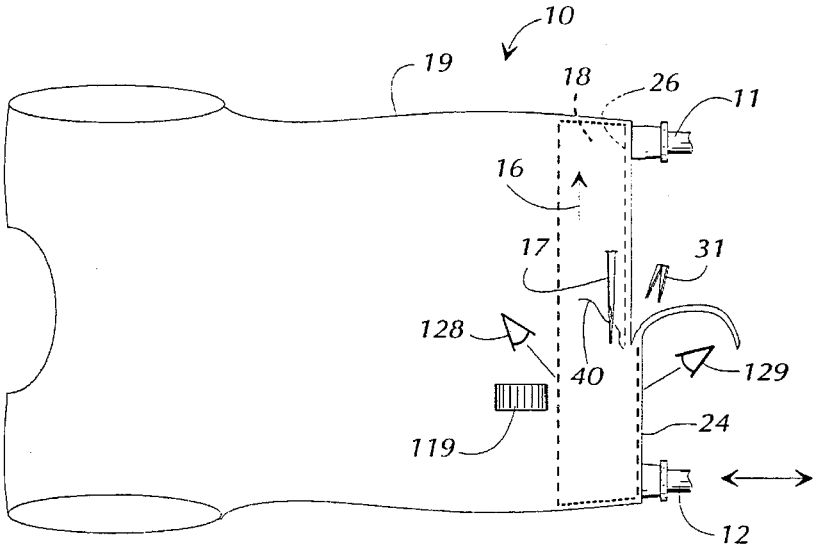
FIG. 3A is an illustration of the shirt body and the waist band, showing schematically how the parts are guided and sewn together.
Figure 3B:
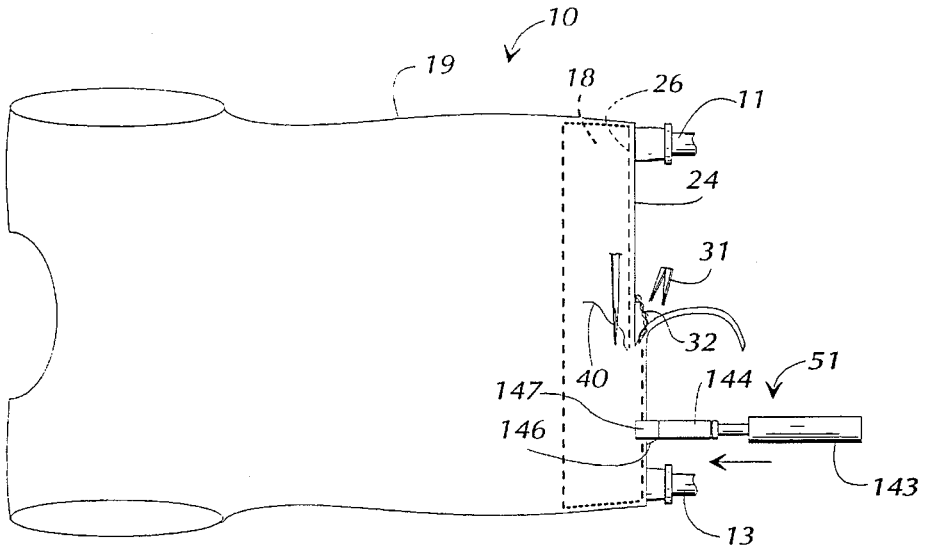
FIG. 3B is a schematic illustration of the completion of the sewing operation and the sewing off of the garment by the sewing needle.

Once the knitted waist band has been received on the spindles, the operator then places the waist edge 24 of the shirt body 19 in telescoped relationship about the waist band 18 until its waist edge is aligned with the edges 22 and 23 of the waist band 18. As shown in FIG. 2, the aligned edges 22, 23 and 24 are placed in the sewing path 16, in alignment with the sewing needle 17 of the sewing machine. As illustrated in FIG. 3A, the waist band 18 and shirt body 19 are moved in the direction indicated by arrow A about the spindles 11–14 and the sewing needle 17 forms stitches 29 at the aligned edges 22, 23 and 24 of the garment parts. Generally, the stitches 29 are formed as overedge chain stitches extending about the edges 22, 23 and 24 of the garment parts. A conventional trimmer 31 cuts a portion of the garment parts that overlie the sewing path away from the garment parts, thereby assuring the finished garment has neat, aligned edges. As the sewing operation nears completion, as shown in FIG. 3B, the garment is progressively urged out of the sewing path 16 so that the sewing needle sews off of the garment and forms a thread chain 32 extending from the garment.

Figure 4:
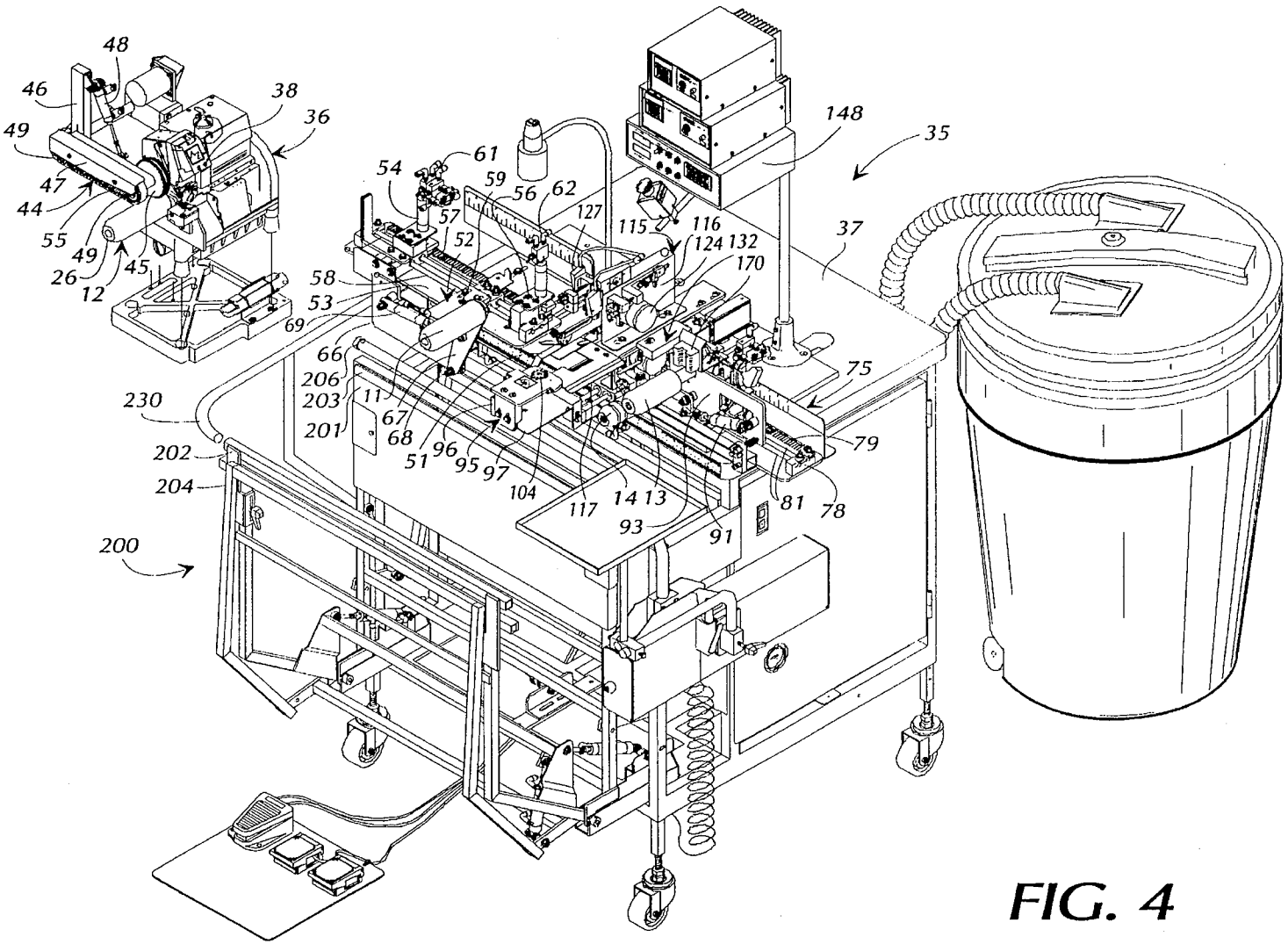
FIG. 4 is a perspective illustration of the waist band attachment system.
Figure 5:
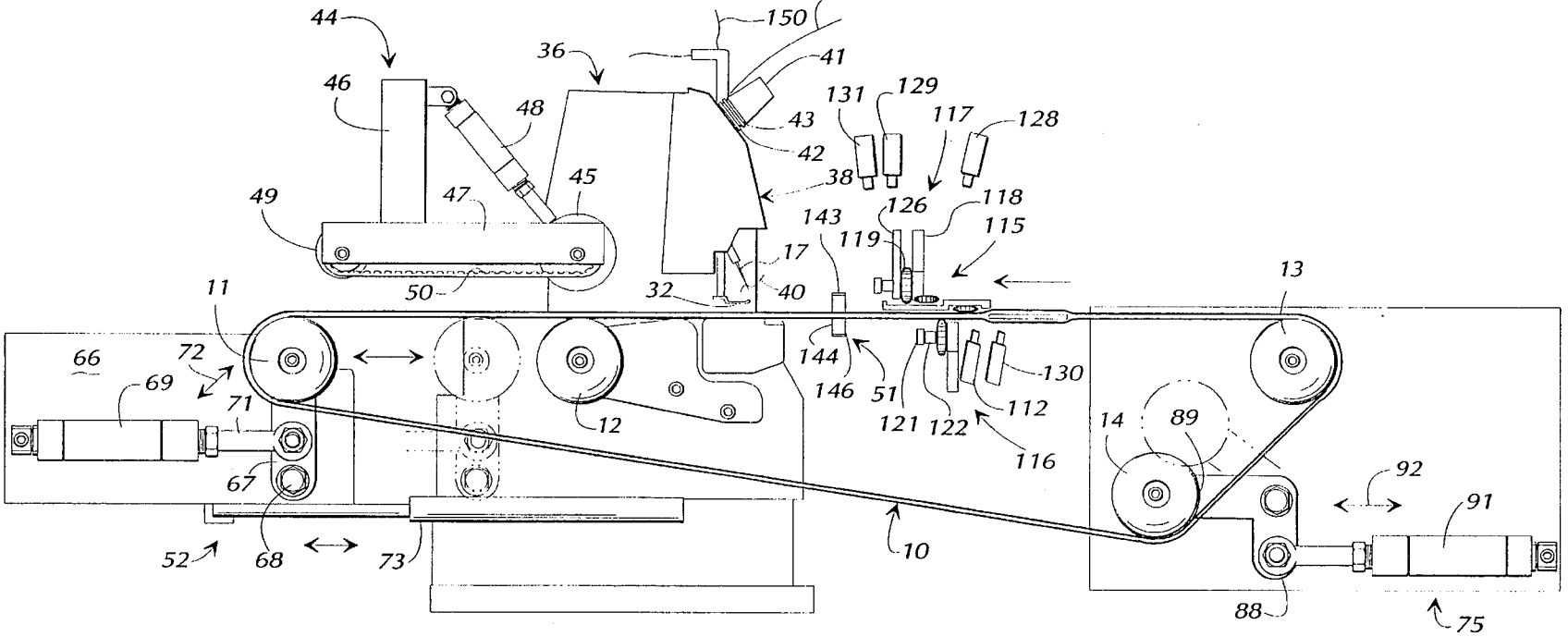
FIG. 5 is a front schematic illustration of the system of FIG. 4, showing how the guide spindles function to guide the garment parts through the sewing machine.

As generally illustrated in FIGS. 4 and 5, wherein the operative components are shown for performing the functions illustrated in FIGS. 1–3, the waist band attachment system 35 includes a sewing machine 36 which is mounted on a work table 37 for the waist band attachment system. The sewing machine 36 includes a sewing head 38 positioned above the sewing path and which includes the sewing needle 17, loopers (not shown) and the presser foot 39 of the sewing machine. A series of threads 40, 40' and 40" are supplied to the sewing needle and loopers from thread supply rails (not shown) for forming the overedge stitching 29 (FIG. 3A). Thread tensioners 41, 41' and 41" (FIG. 4) are mounted to the sewing machine adjacent the sewing head 38. The thread tensioners each include a pair of opposed tension plates 42 and 43 between which the threads are received, and a compression spring (not shown) that biases the upper tension plate 43 toward tension plate 42 to apply tension to the thread received therebetween. The threads 40, 40' and 40" pass through the thread tensioners, extending to the needle and loopers, and are placed under a desired degree of tension according to the desired tightness of the stitches to be formed in the garment.

A garment puller 44 is mounted adjacent and in operative relationship with respect to sewing head 38 and guide spindle 11. Garment puller 44 is mounted above and along the sewing path 16 and includes a toothed puller wheel 45 that is mounted to a pivot arm 46 that moves the puller wheel downwardly toward and upwardly away from engagement with spindle 12, as indicated by arrows B and B'. The pivot arm 46 is pivotally mounted at its opposite end to an upright support arm 47. Pneumatically actuated cylinder 48 is mounted to the support arm 47 and to the distal end of the pivot arm 46 and controls the arcuate movement of pivot arm.

Figure 6:
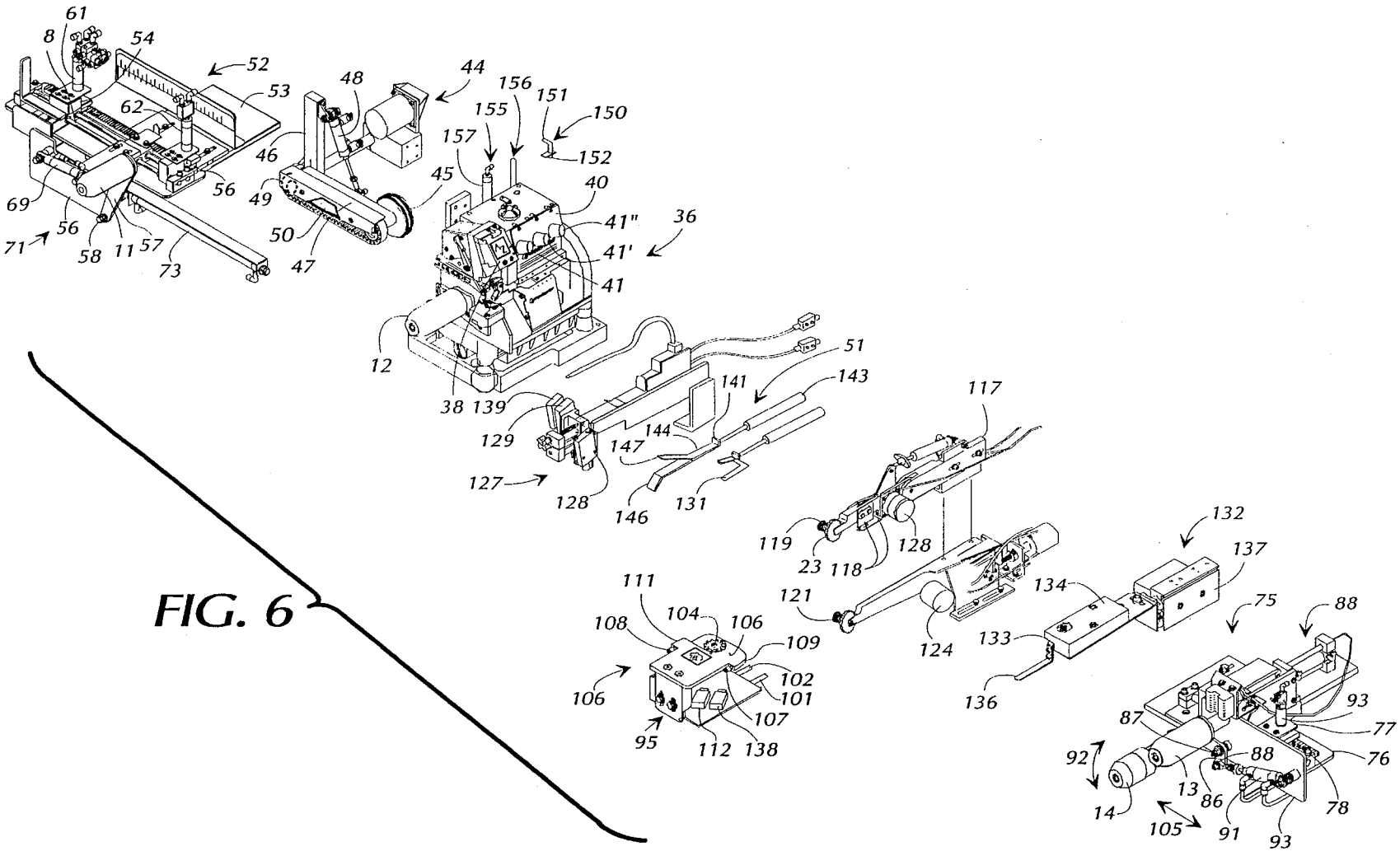
FIG. 6 is an expanded perspective illustration of the major components of the system.

A reciprocally stepping motor is connected to a sprocket 49 mounted at the base of pivot arm 47 for rotating the sprocket. A drive belt 50 is encircled about the sprocket 49 and puller wheel, linking the sprocket and puller wheel in a driving relationship so as to cause the puller wheel to rotate in a clockwise direction with the rotation of the sprocket by the motor. The spindle 12 of sewing head 38 functions as an idler spindle, which is positively rotated by the rotation of the drive wheel when the puller wheel is moved down into its operative position with the waist band and shirt body engaged between the puller wheel and the spindle 12. A garment ejector 51 is mounted adjacent the sewing head 38, positioned along the sewing path upstream from the garment puller 44 for ejecting the garment from the system upon completion of the sewing operation. FIG. 5 shows sewing head 38, garment puller 44, garment ejector 51 and spindles 11–14 in side elevation. FIG. 6 shows these same components of the system in more detail.

Figure 7:
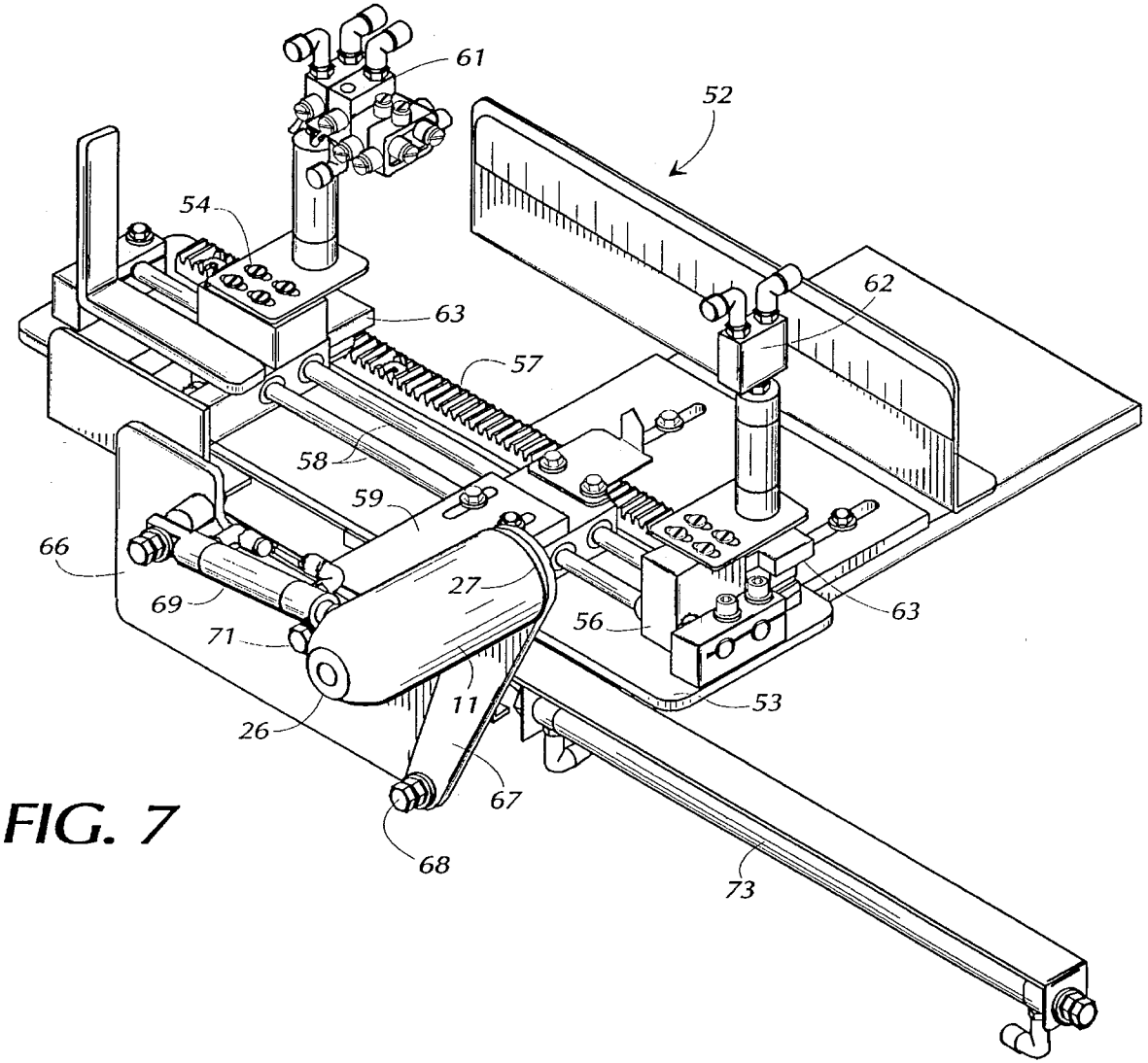
FIG. 7 is a perspective illustration of the left guide spindle assembly of the invention.

As shown in FIGS. 6 and 7, the leftmost spindle 11 is mounted to a first movable guide spindle assembly 52. Spindle assembly 52 includes a mounting plate 53 that is attached to the work table, and slide bar mounts 54 and 56 attached to a track 57 mounted to the mounting plate 53. Slide bars 58 extend between and are supported by the slide bar mounts 54 and 56. A slide block 59 is mounted on and is movable along slide bars 58, with the movement at the slide block limited by the spacing of the slide bar mounts. Locking cylinder assemblies 61 and 62 are mounted to the slide bar mounts 54 and 56 for locking the slide bar mounts in a desired position along the track 59. The locking cylinder assemblies generally are pneumatically actuated cylinders and each include lock plates 63 movable into and out of locking engagement with the teeth of track 57 upon actuation of the cylinders so as to hold the slide bar mounts in a desired, set position with respect to the mounting plate. The slide bar mounts are movable along the track 57 and are locked in place by the locking cylinder assemblies 61 and 62 (FIG. 7) to enable the spacing between the slide bar mounts and thus the range of movement of the slide block, to be set as desired. This enables adjustment of the amount of movement of the spindle toward and away from sewing head 38 for the purpose of size adjustment with respect to larger and smaller of the garment parts.

An upright support plate 66 is mounted to the slide block 59, and is movable longitudinally with the movement of block 59 along the slide bars 58. A pivot arm 67 is pivotedly mounted to the upright support plate at its lower end by pivot pin 68, with spindle 11 rotatably mounted to the upper end of the pivot arm. A pneumatically actuated cylinder 69 is mounted to the upright support plate 66, extending along the front surface thereof, and includes piston rod 71 that is attached at its free end to the pivot arm 67 at a point intermediate the pivot pin 68 and spindle 11. When cylinder 69 is actuated, the pivot arm is pivoted about pivot pin 68 such that spindle 11 is moved through an arcuate path as indicated by double-headed arrow 72 generally toward and away from sewing head 38.

As shown in FIGS. 6 and 7, an elongated air cylinder 73 is positioned below the first spindle assembly 52, extending along the sewing path. Elongated air cylinder 73 is a pneumatically operated cylinder having a piston rod (not shown) to which the upright support plate 66 is mounted. The upright support plate moves longitudinally between the slide bar mounts 54 and 56 by the extension and retraction of the piston rod of air cylinder 73. As a result, spindle 11 is moved between a nonoperative, resting position (FIG. 4) and its operative, initial stretching position (as shown in FIG. 5) upon the actuation of air cylinder 73.

A second or right side guide spindle assembly 75 is shown at the right side of FIG. 6, which assembly is on the other side of sewing head 38 from the first spindle assembly 52. The second spindle assembly 75 (FIGS. 6 and 8) has a substantially similar construction to the first spindle assembly, including a mounting plate 76 having a first slide bar mount 77 mounted at one end of the plate 76, and a second slide bar mount 78 movably mounted along a track 79 positioned on the mounting plate. A pair of slide bars 81 extend between and are supported by the slide bar mounts. A slide block 82 is mounted on and is movable along the length of the slide bars 81 between the slide bar mounts 77 and 78, in similar fashion to the first spindle assembly 52. An upright support plate 83 is mounted to, and thus is movable with slide block 82 along the slide bars 81.

Spindles 13 and 14 are rotatably mounted to the front facing surface upright support plate 83 and are movable in a direction parallel to the sewing path with the movement of the support plate along slide bars 81. The spindles 13 and 14 further can be tilted or reoriented with respect to the sewing path by a set screw 84 mounted between the mounting plate 76 and the upright support plate 83. The set screw can be manipulated to cause the support plate 83, and thus the guide spindles 13 and 14 to tilt with respect to the sewing path.

Figure 8:
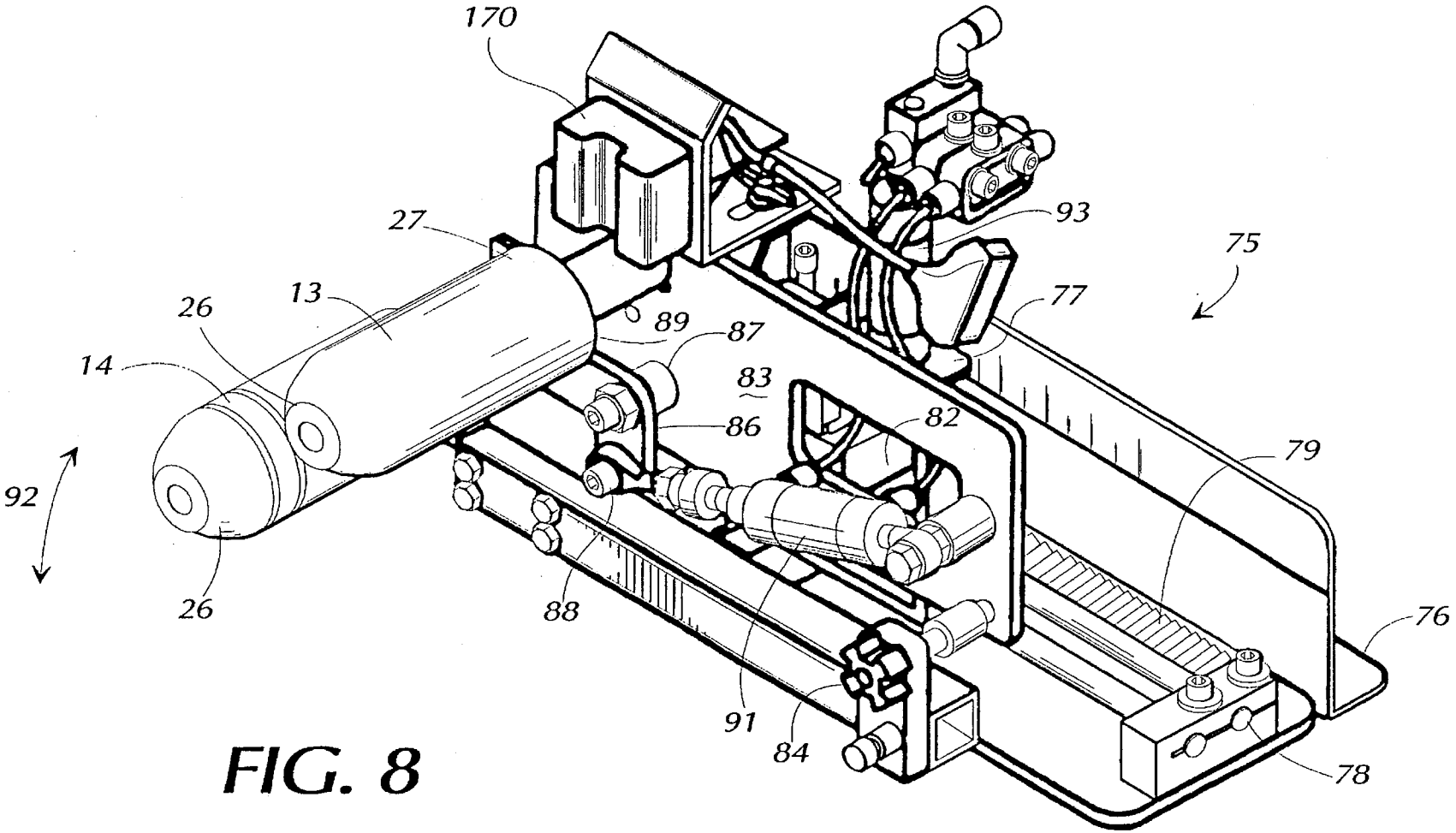
FIG. 8 is a perspective illustration of the right spindle assembly.

As FIG. 8 illustrates, an L-shaped pivot arm 86 is attached to upright support plate 83 as shown at 82 and has a first end 88 and a second end 89. The lower spindle 14 is mounted to the second end 89 of pivot arm 86 and is rotatable about its longitudinal axis. Pneumatically actuated cylinder 91 is mounted to the upright support plate, connected to the first end 88 of pivot arm 86. The cylinder 91 is actuated at the start of a sewing operation after the garment body is received over the spindles. When cylinder 91 is actuated, spindle 14 will move back and forth through an arc as indicated by double-headed arrow 92 (FIG. 5) generally toward and away from spindle 13. The movement of spindle 14 further stretches the waist band prior to the start of the sewing operation so that the circumference of the waist band substantially matches the circumference of the garment body (FIG. 1).

Like spindle assembly 52 (FIGS. 4, 6 and 8) spindle assembly 75 includes a pneumatically activated plate cylinder (not shown) that controls the longitudinal movement of the second spindle assembly along the sewing path to move spindles 13 and 14 toward and away from the sewing head. Such longitudinal movement of the second spindle assembly further stretches the matched edges of the waist band and shirt body to prevent wrinkles from being sewn therein. A pneumatically actuated locking cylinder 93 also is mounted to slide block 82, and includes a locking foot which, when distended, engages and clamps against teeth of track 79. The engagement with the teeth of track 79 locks the slide block in place on the mounting plate to set the amount of travel of the upright support plate 83 and the spindles with the actuation of the plate cylinder. When the travel of spindles 13 and 14 is to be less or greater from sewing head 38, cylinder 93 is actuated to lift its piston rod (not shown) away from and out of locking relationship with respect to the track 79, whereupon the slide block can be moved along slide bars 81 to adjust the distance of travel of spindles 13 and 14 with respect to sewing head 38 as needed to accept smaller or larger sized garments.

Figure 9A:
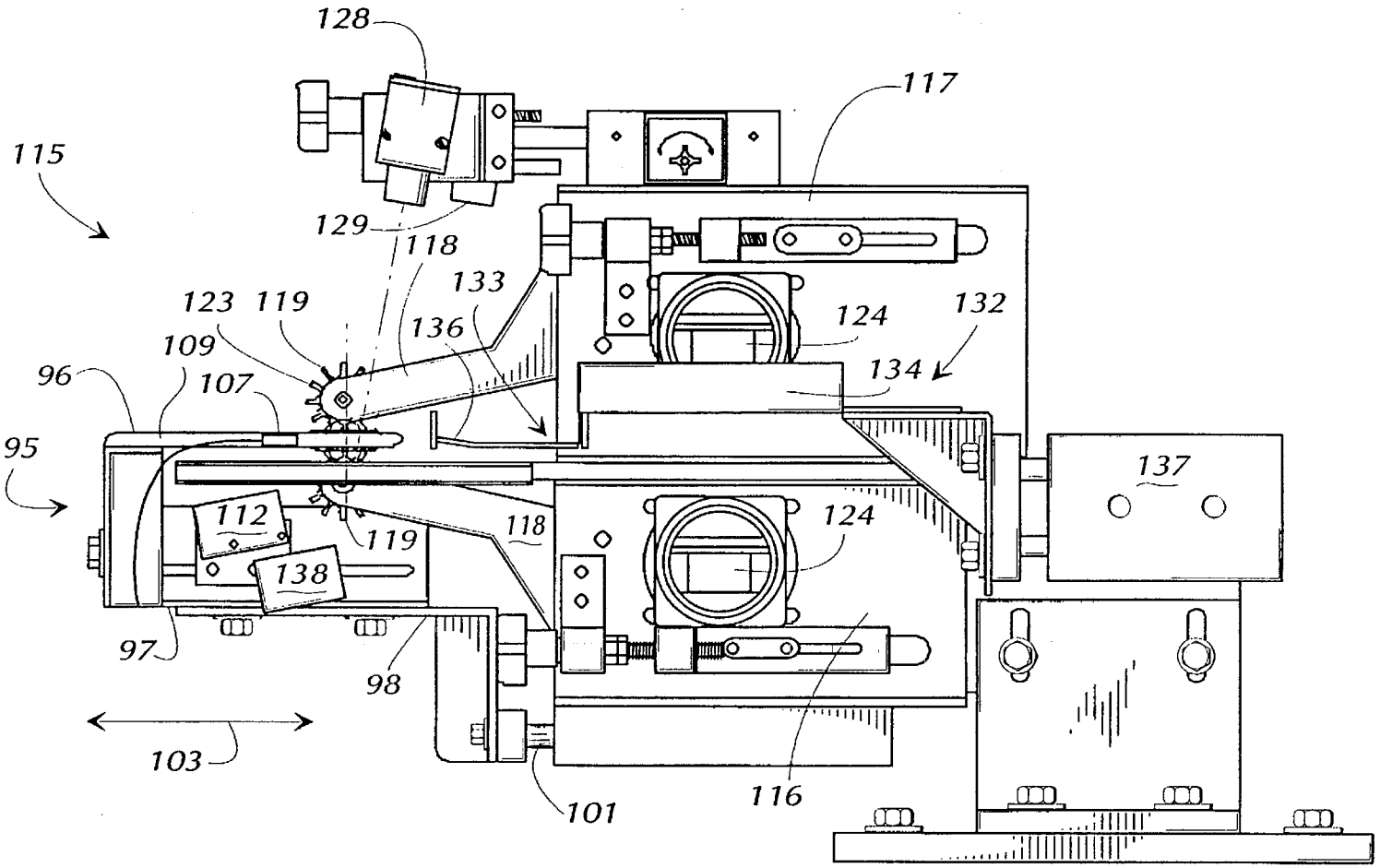
FIG. 9A is a side elevational view of the edge guide system and the guide tongue assembly.
Figure 10:
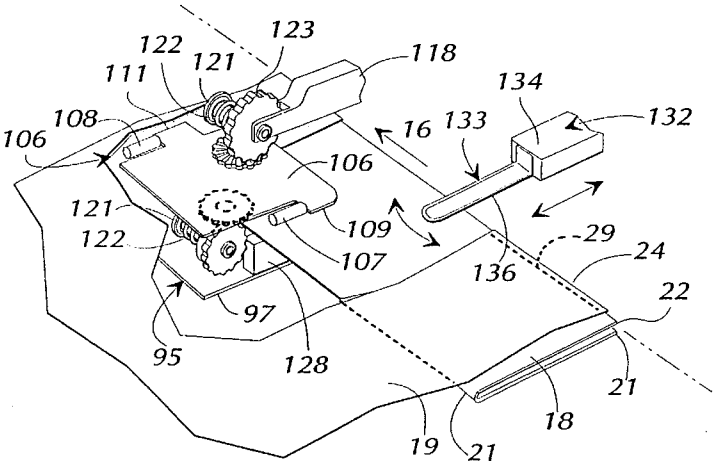
FIGS. 10 and 10B are a perspective illustration of a portion of the star wheels of the edge guide assembly and idler wheels of the guide tongue assembly and the seam switch, illustrating how the garment parts are engaged thereby.
Figure 9B:
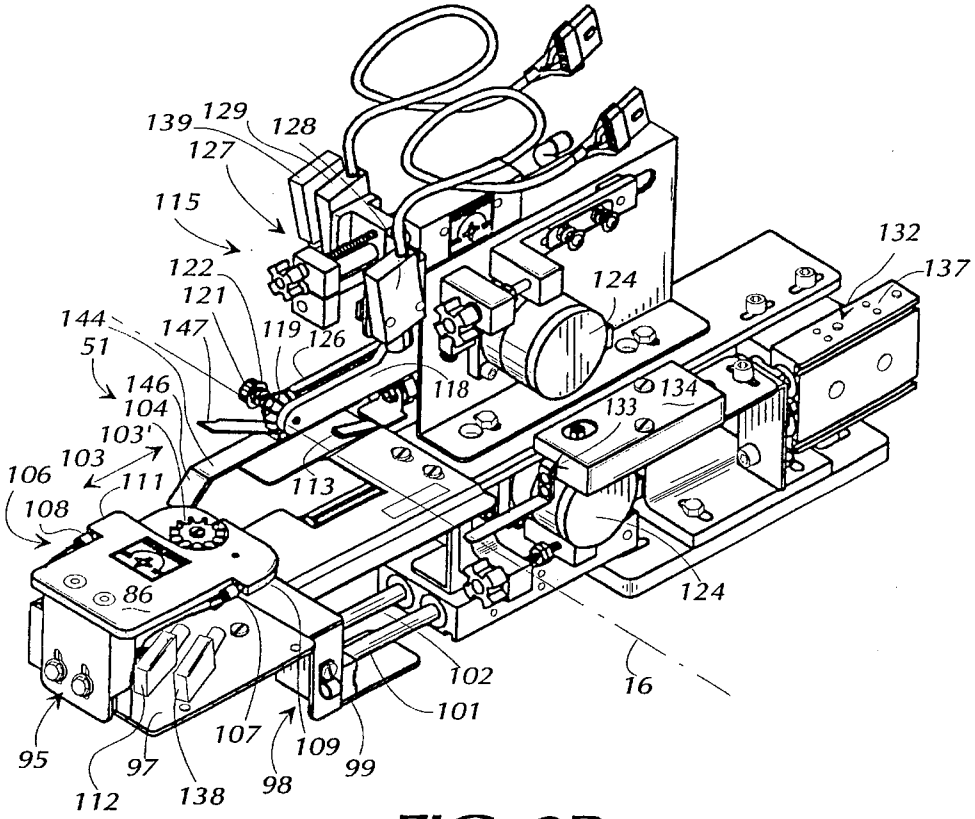
FIG. 9B is a perspective illustration of the edge guide assembly and the guide tongue assembly.

A guide tongue assembly 95 (FIG. 4) is positioned along the sewing path, movably mounted to the work table 37 of the waist band attachment system 35 and positioned upstream from the sewing head 38. As shown in FIGS. 6, 9A and 9B, the guide tongue assembly is a substantially C-shaped shelf generally positioned outside of the sewing path of the waist band attachment system until actuated, and includes a horizontally oriented upper support plate 96 and a horizontally oriented lower plate 97 extending parallel to and spaced from the upper support plate 96. A substantially L-shaped mounting bracket 98 is attached to the downwardly facing surface of lower plate 97, extending toward the sewing path and having a downwardly extending front portion 99. Piston rods 101 and 102 of a pair of air cylinders (not shown) are attached to the downwardly extending front portion 99 of the mounting bracket. Upon actuation of the air cylinders of the piston rods 101 and 102, the piston rods are extended and retracted to move the guide tongue assembly laterally toward and away from the sewing path in the direction of double headed arrow 103. The retraction and extension of the piston rods move the guide tongue assembly between its operative position shown in FIG. 9A in response to the placement of the placement of the waist band material within the sewing path 18, and its inoperative, nonengaging position, shown in FIG. 9B, in response to the sewn edges of the garment approaching the sewing needle at the end of a sewing cycle.

Figure 10B:
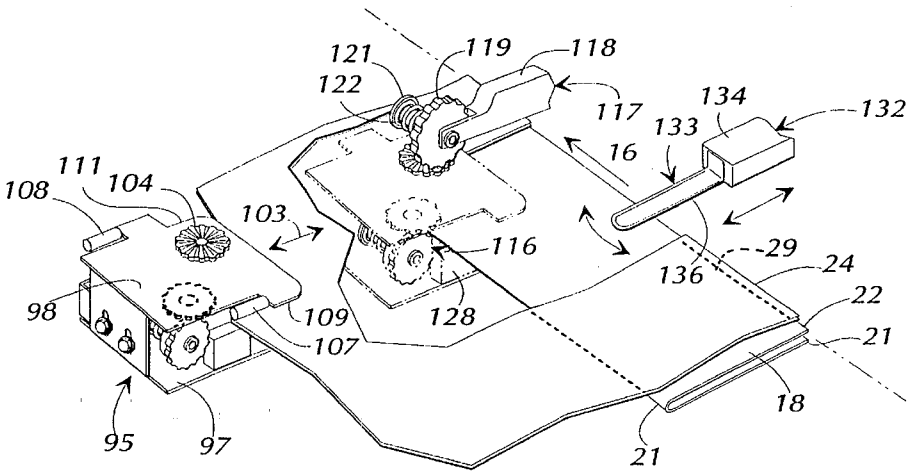
Figure 10A:
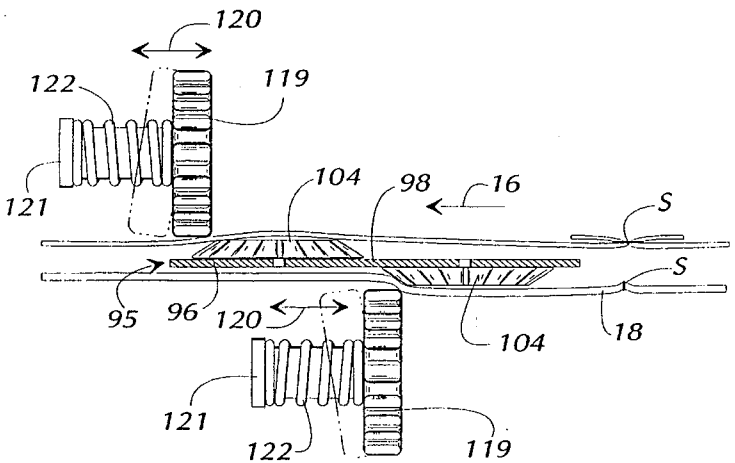
FIG. 10A is a front schematic illustration of the spring mountings of the star wheels and the movement of the star wheels against the springs to enable a seam to pass thereunder.

As FIGS. 9A and 10A illustrate, idler wheels 104 (only one of which is shown) are mounted in the upper and lower surfaces of the upper support plate 96 of the guide tongue assembly 95. The idler wheels are positioned along the sewing path in a staggered relationship. Generally, the idler wheels comprise toothed sprockets formed from plastic or similar material and are rotatable about vertical axes extending through the upper plate.

Additionally, a decurling means 106 (FIGS. 6 and 9B) is mounted to the guide tongue assembly 95, positioned along the upper support plate thereof. The decurling means generally includes a pair of air nozzles 107 and 108 positioned along the upstream and downstream side edges 109 and 111 of the upper support plate 96, and connected to an air supply means (not shown) such as a compressor or an air tank for supplying a flow of air under pressure to the nozzles. The nozzles direct a flow of air across the sewing path, directed at the edges 22, 23 and 24 (FIGS. 1 and 2) of the waist band 18 and shirt body 19. The air flow causes the rolled edges of the waist band and shirt body to be uncurled and flattened prior to being engaged by the sewing needle of the sewing head.

The guide tongue assembly further includes a band edge sensor 112 mounted between the upper and lower plates 96 and 97 and directed upwardly toward the upper plate as shown in FIG. 9A for detecting the position of the folded edge of the waist band, which is indicative of the presence of the cut edges of the waist band being in or out of the sewing path. The band edge sensor 112 generally is a photo-cell or similar sensing means that detects the folded edge of the waist band by the covering and uncovering of a reflector plate (not shown) mounted on the underside of the work table 43 (FIG. 4) by the movement of the folded edge of the waist band thereacross.

As further illustrated in FIGS. 6, 9A, and 9B, a shirt edge guide assembly 115 is positioned along the sewing path opposite the guide tongue assembly. The edge guide assembly includes lower and upper operative edge guide units 116 and 117, with the lower operative unit mounted to the work table 43 and the upper operative unit mounted to the lower operative unit. The operative edge guide units 116 and 117 have substantially mirror constructions, each including a support arm 118 that extends laterally toward the sewing path 16 (FIG. 9B). The support arms are pivotable from nonoperative positions, shown in FIG. 9B, to operative positions in the sewing path as shown in FIG. 9A upon the start of a sewing operation, and each supports at its distal end a toothed star wheel 119.

The star wheels 119 are rotatably mounted to the support arms 118 by pivot pins 121, with springs 122 positioned between the star wheels and the ends of the pivot pins as shown in FIGS. 5, 10A and 10B. The springs enable some slight movement of the star wheels in the direction of the sewing path. Thus, when ridges or seams in the fabric of the garment parts pass beneath the star wheels, the star wheels tend to give and move slightly, as indicated by arrows 120, (FIG. 10A) to the positions shown in dashed lines to enable the seams or ridge to pass thereunder without catching or binding against the star wheels and jamming the sewing operation.

The star wheels 119 have large gaps between their radially extending, rounded edge teeth 123 so that the waist band 18 and shirt body 19 (FIG. 7) can move along the sewing path 16 in a direction transverse to the star wheels in lightly sliding engagement with respect to the teeth of the star wheels. The star wheels are positioned so as to engage and mesh with the toothed idler wheels 104 of the guide tongue assembly, as shown in FIGS. 5 and 10A, with the shirt body and the waist band engaged therebetween. The star wheels 119 lightly engage the idler wheels 104 of the guide tongue assembly 95, with the waist band and shirt body engaged therebetween, and tend to pull the edges of the waist band and shirt body into or out of the sewing path as the star wheels are rotated so that the waist edges 22, 23 and 24 (FIGS. 1 and 2) of the waist band 18 and shirt body 19 are maintained in matched alignment and are aligned with the sewing path 16.

As shown in FIG. 9B, stepping motors 124 are mounted to the operative edge guide units 116 and 117. Each stepping motor is a reciprocating motor connected to the star wheels 19 in driving relationship by timing belts 126 extending along support arm 118. The motors rotate the star wheels clockwise/counterclockwise as needed to adjust the position at the waist band and shirt body edges in the sewing path.

A sensor array 127 is mounted to the upper operative edge guide unit 117, positioned above and directed toward the sewing path 16 (FIG. 9B). The sensor array generally includes a band sensor 128 and a body edge sensor 129 positioned on opposite sides of the support arm 118 of the upper operative edge guide unit 117. Each of the sensors generally is a photoelectric cell or similar sensing means, such as a laser detector or the like, and is directed toward band and body reflector plates 131 (FIG. 9A).

As indicated in FIG. 9A, the band sensor 128 is directed downwardly toward its band reflector plate 130 so as to detect the presence of the waist band moving into the sewing path. As the waist band is moved over the band reflector plate 130, it breaks the beam of the band sensor. In response, the first spindle assembly 52 (FIG. 4) is caused to be moved longitudinally along the sewing path away from spindles 12, 13 and 14, to stretch the waist band to a first, initially stretched position. The tripping of the band sensor further triggers the movement of the body reflector plate 131 laterally into the sewing path, with the body reflector plate 131 being positioned above the waist band. At the same time, the guide tongue assembly 95 is caused to be moved laterally in the direction of arrow 103' (FIG. 9B) inwardly toward the sewing path into a position above the waist band, and a seam switch 132 likewise is caused to be moved into the sewing path 16 over the waist band.

The body sensor 129, positioned on the downstream side of the support arm 118 of the operative edge guide unit 117. The body sensor is directed downwardly toward the sewing path and toward the body reflector plate 131 once the body reflector plate has been moved into its engaged position in the sewing path. Body sensor 129 functions to detect the waist edge 24 (FIGS. 1 and 2) of the shirt body 19 being in or out of out of the sewing path, which is signaled by the covering and uncovering of the body reflector plate 131 (FIG. 9A). Upon detection of the waist edge of the shirt body being in or out of the sewing path, the motor 124 of the upper operative edge guide unit is actuated and causes the upper star wheel 119 therein to rotate either counterclockwise or clockwise to move the waist edge of the shirt body into or out of the sewing path.

At the same time, the detection of the folded edge of the waist band moving across the beam of band edge sensor 112, indicating the movement of the cut edge of the waist band moving into and out of the sewing path, causes the actuation of the motor 124 of the lower operative edge guide unit 116. The motor rotates the star wheel 119 of the lower operative edge guide unit either counterclockwise or clockwise so as to push or pull the cut edges of the waist band into or out of the sewing path simultaneously with the pushing and pulling of the waist edge of the shirt body into and out of the sewing path. As a result, the waist edges of the waist band and the shirt body are maintained in alignment with one another as they are engaged by the sewing needle of the sewing head. Thus, this reciprocating motion ensures that the waist band material is evenly attached about the waist edge of the shirt body. The positions of the band edge sensor and body edge sensor also can be adjusted by the operator to adjust the amount of trimming of the shirt body. For example, the position of the eyes can be adjusted to trim ⅛ inch of material or more off of the shirt body and a corresponding portion of the waist band as desired.

As illustrated in FIGS. 6 and 10B, a lever switch 133 is supported on lower operative edge guide unit 116 and is movable into the sewing path upon actuation of band sensor 128. The lever switch 133 includes a switch housing 134 mounted to the piston rods of an air cylinder assembly 136 that extends and retracts its piston rods upon the tripping of the band sensor 126, and a guide finger 137 mounted to the front edge of the housing so as to move into and out of the sewing path with the movement of the switch housing. This places the guide finger 134 between the plies of material, on top of the folded waist band and below the shirt body. With this arrangement, when the plies of material are being sewn together and the previously sewn portion, as represented by the line of stitching 26 (FIG. 10B), approaches and engages the guide finger of the lever switch, the guide finger is deflected and actuates the switch. This causes cylinder assembly 137 to retract the lever switch 133 to permit the stitching 26 to pass on beyond the edge guide assembly 115.

As FIG. 5 shows, an additional pair of guide sensors 138 and 139 are mounted along the sewing path of the shirt body and waist band. Guide sensor 138 is mounted adjacent band edge sensor 112, slightly inward toward the sewing path of the garment and is directed upwardly toward the waist edge of the waist band. Guide sensor 139 is mounted adjacent body edge sensor 129, slightly inward toward the sewing path of the garment and is directed downwardly toward the waist edge of the shirt body. The guide sensors communicate with the upper and lower operative edge guide units 117 and 116 during the initial jog or run of the garment. The guide sensors 138 and 139 detect the position of the edges of the waist band and shirt body and engage the upper and lower operative edge guide units to urge the edges of the shirt body and waist band back and forth across the sewing path to positions aligned with the cutter of the sewing machine. As a result, the waist edges of the waist band and shirt body are caused to pass immediately adjacent, but without engaging, the cutter of the sewing machine during the initial jog of the system prior to a sewing operation. This eliminates the tendency of the material to rub against the cutter during the jog, which causes pleating and twisting of the fabric against the cutter. After the jog has been completed, control of the operative edge guide units is switched to the band and body edge sensors 112 and 129, which control the positioning of the shirt body and waist band during a sewing operation.

As illustrated in FIG. 6, garment ejector 51 is positioned downstream from body reflector plate 131, and is movable into the sewing path upon actuation of the sewing assembly. The garment ejector includes a support plate 141 that is mounted to the work table 37. Support housing 142 is mounted over support plate 141 and accommodates a pneumatic cylinder 143. The pneumatic cylinder 143 is connected to an ejector plate 144 having a downwardly turned distal end 146, and an upwardly curled or hooked catch portion 147 positioned rearwardly from the distal end. When cylinder 143 is actuated, it pushes ejector plate 144 forwardly across and beyond the sewing path of the sewing head 38, which causes the work product to be pushed out of the sewing path and off of the spindles 11–14. Initially, the ejector is engaged in response to the tripping of the lever switch 133 and urges the work product progressively out of the sewing path so that the sewing machine sews off of the garment. Thereafter, the movement of the ejector is halted for a short time while the sewing machine continues to sew and forms a thread chain 32 after which the ejector moves the garment further forwardly and off of the spindles.

A stitch counter 148 (FIG. 4) is mounted to the work table 37 of the waist band attachment system 40 and is connected to the sewing head 38. The stitch counter 148 generally comprises a programmable computer or similar processing unit having a sensing means for recording the number of stitches sewn in the waist band and shirt body by the sewing head. The stitch counter is programmed with a first stitch count of a desired number of stitches to be formed in garment. Upon detection of the sewing of a desired number of stitches in the garment by the stitch counter, the pneumatic cylinder 91 actuated, causing the cylinder to retract its piston rod. In response, pivot arm 86 is rotated about its pivot pin 87 to urge the first end 88 of the pivot arm 86 downwardly in the direction of arrow 92. As a result, spindle 14 is moved downwardly, causing the waist band and shirt body to be further stretched and flattened to prevent wrinkles from being formed adjacent the presser foot and needle of the sewing machine, and being sewn in the finished garment. Without such an additional stretching movement, bunching or wrinkles can tend to form in the garment.

The stitch counter 148 further operates in conjunction with the band and body edge sensors 112 and 129 to detect the misfeeding of the garment through the system. The stitch counter counts the stitches formed by the sewing station during the sewing operation while the band and body edge sensors detect the presence and absence of the edges of the waist band and shirt body across the sewing path. If the band edge sensor or the body edge sensor, or both, is not tripped, indicating the detection of the waist band and/or shirt body crossing the sewing path, within a specific stitch count counted by the stitch counter, a jammed or misfed condition is detected. The sewing machine accordingly is stopped to enable the operator to clear the misfed garment from the waist band attachment system without further damage to the garment.

A tension opener assembly 150 (FIGS. 4, 5 and 11) is mounted to the sewing machine, positioned adjacent the thread tensioner 41 for the needle thread 40 of the sewing machine. The tension opener assembly includes an air cylinder 151 connected to an air supply (not shown), and a push rod 152 connected to the air cylinder 151. The push rod is mounted above the tension plates 42 and 43 of thread tensioner 41 and has a pointed end adapted to engage and move between the tension plates. The push rod 152 is extended and retracted by the actuation of the air cylinder toward the end of a sewing operation and tends to urge the tension plates apart. The air cylinder 151 is actuated by the stitch counter 148 counting a second stitch count of stitches being formed in the garment following the tripping of the lever switch 133 and, in response, moves the push rod 152 between the tension plates 42 and 43, thus releasing the tension on the needle thread 40.

Figure 11:
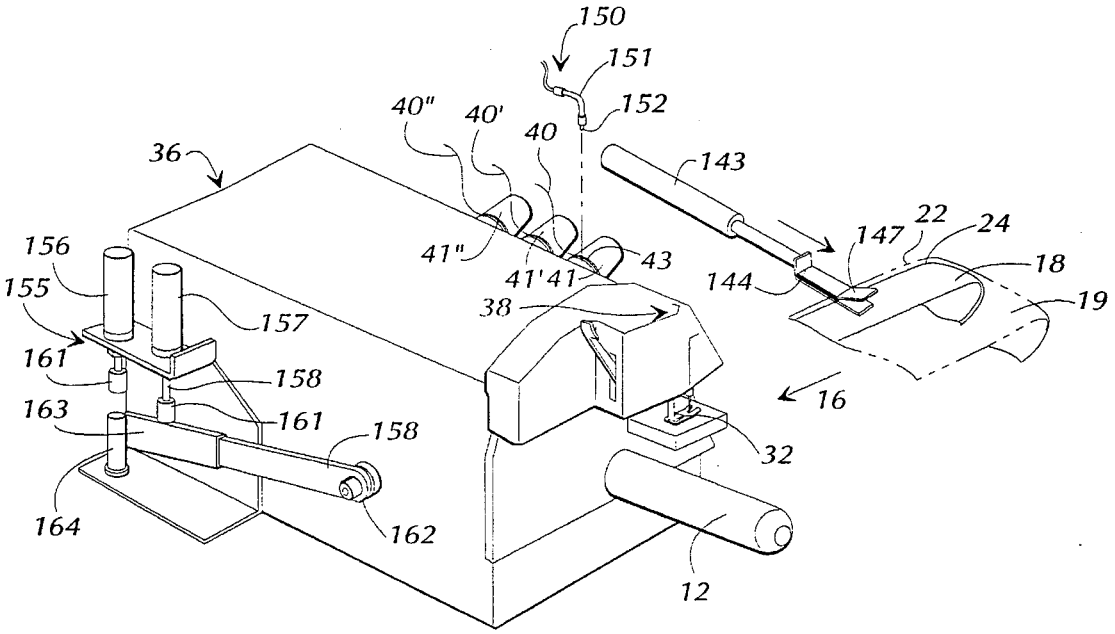
FIG. 11 is a perspective view of the sewing machine, showing the dual footlift cylinder assembly for lifting the presser foot slightly at the completion of the sewing operation and showing the tension opener assembly mounted at the needle thread tensioner.

As FIG. 11 further illustrates, a presser foot lift cylinder assembly 155 is mounted to a downstream side of the sewing machine 36 and is connected to the presser foot 39 of the sewing machine to control the raising and lowering of the presser foot. The presser foot lift cylinder assembly 155 includes first and second air cylinders 156 and 157 positioned in a vertically extending, parallel alignment, and lever 158 pivotally mounted to the sewing machine and extending beneath the cylinders 156 and 157. Each air cylinder has a piston rod 159 having a foot 161 attached to its free end. The lever 158 is an elongated bar connected at a first end 162 to the presser foot 39 by a linkage (not shown) and having a second end 163 positioned to be engaged by the feet of the cylinders. As the feet of the cylinders engage the second end 163 of the lever, causing the lever to pivot downwardly, causing the presser foot to be raised. A stop 164 is positioned adjacent the second end of the lever, beneath the foot 161 of the cylinder 156. The stop is an upstanding bar or rod that limits the downward movement of the foot of cylinder 156 to thus limit the pivoting movement of the lever.

Cylinder 156 is actuated by the tripping of the lever switch 133 (FIG. 6) by the finished garment. In response, cylinder 156 (FIG. 11) extends its foot 161 to urge the second end 163 of the lever 158 downwardly a short distance. As a result, the presser foot 39 is raised approximately ⅛ of an inch to enable the garment to be moved out from under the sewing head by the ejector. Upon completion of a sewing operation, cylinder 157 extends its foot 161 against the lever, moving the lever to its fully lowered position to cause the presser foot to be raised fully for removal of the garment.

A thumb swipe switch 170 (FIG. 4) is mounted above and to the right of the edge guide assembly. Upon contact of the switch by the operator, the system is placed in operation. This allows the operator of the system to place the garment parts about the spindles 11–14 and with only a small movement of her thumb through the recess of the thumb swipe switch, begin the automatic operation of the system.

Figure 12:
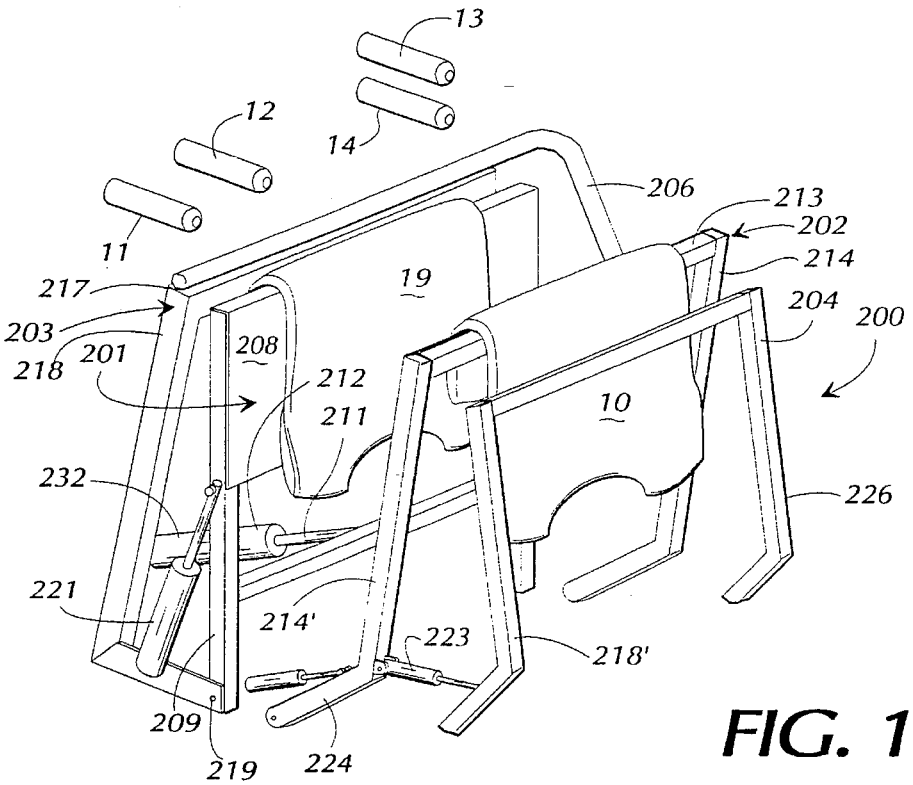
FIGS. 12–16 are perspective, progressive illustrations of the stacker, showing how the stacker functions at the end of the cycle of the sewing head.

As FIGS. 4 and 12 illustrate a stacker 200 is positioned adjacent the work table of the waist band attachment system for maintaining a supply of unfinished shirt bodies for placement on the spindles 11–14, and for automatically removing the completed work product after the sewing cycle has been completed.

As illustrated in FIG. 12, the stacker 200 includes a supply frame 201 and an accumulator frame 202, positioned between the supply frame 201 and the work table; clamp bars 203 and 204 mounted to the supply and accumulation frames, respectively, and a wiper bar 206. As illustrated in FIG. 4, the supply frame, accumulator frame and clamp bars all are pivotally mounted at their lower ends on a common support 207 so as to be pivotable toward and away from one another as illustrated in FIGS. 12–16. The supply frame generally is rectangularly shaped, having an upper plate 208 mounted on and supported by legs 209 attached to each side of the upper plate, and a cross bar 211 extending between the legs below the upper plate. The supply frame supports a supply of shirt bodies 19 on its upper plate. The position of supply frame 201 is controlled by a pneumatic cylinder 212 which is mounted to a stationary support and is connected to the cross bar 211 of the supply 201 frame.

Likewise, the accumulator frame 202 generally is rectangularly shaped and includes an upper bar 213 supported by spaced parallel legs 214, and supports a stack of finished garments 10 folded over its upper bar 213. The position of the accumulator frame is controlled by a pair of cylinders 216 (only one of which is shown) mounted on a stationary support and are connected to the legs 214 of the accumulator frame.

Figure 13:
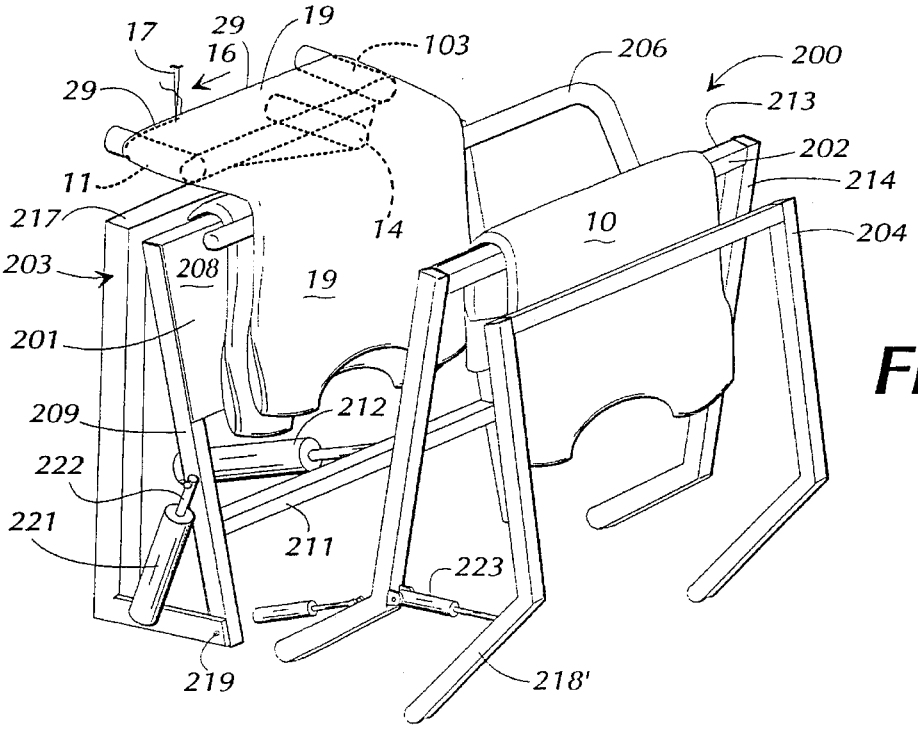
Figure 14:
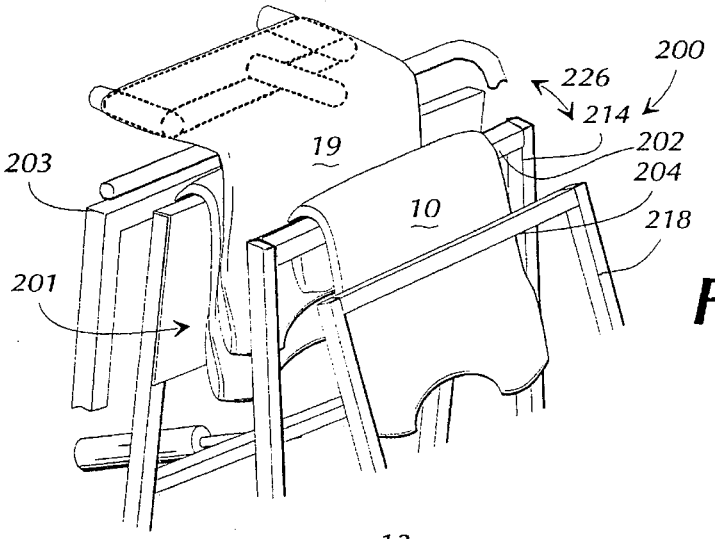

As shown in FIGS. 12–16, the clamp bars 203 and 204 generally move in unison with the supply and accumulator frames 201 and 202, but additionally can be moved toward and away from the supply and accumulator frames between clamped and unclamped positions. Each of the clamp bars 203 and 204 generally is substantially rectangularly shaped and includes an horizontally extending upper bar 217 adapted to engage the upper plate 208 and upper bar 213 of the supply and accumulator frames 201 and 202 when the clamp bars are in their clamping positions against the supply and accumulator frames as shown in FIGS. 12 and 14. The clamp bars further include a pair of spaced vertically extending legs 218 supporting the upper bar 217. As FIG. 12 illustrates, the legs 218 of the first clamp bar 203 are pivotally attached at their distal ends to the lower ends of the legs 209 of the supply frame 201 by pivot pins 219 (only one of which is shown) to enable the clamp bars to pivot between their clamped and unclamped positions. A pneumatic cylinder 221 is mounted to one of the legs 214 of the clamp bar 203 and includes a piston rod 222 attached at its free end to the adjacent leg. As the pneumatic cylinder 221 is actuated, it extends and retracts its piston rod 222, which causes the clamp bar 203 to pivot about its pivot pin 219 rearwardly away from the supply frame 201 or forwardly towards clamping engagement with the upper bar of the supply frame as illustrated in FIGS. 12 and 13. Similarly, a pneumatic cylinder 223 is pivotally attached to a forwardly facing side surface of leg 214' of the accumulator frame, positioned between the accumulator frame and its clamp bar 204. These pneumatic cylinders include a piston rod 224 that is attached to the adjacent leg 218' of clamp bar 204 such that upon actuation of the cylinder 223, piston rod 224 is extended and retracted so as to cause the clamp bar 204 to be pivoted toward and away from the accumulator frame, into and out of its clamping positions with respect to the accumulator frame.

Figure 15:
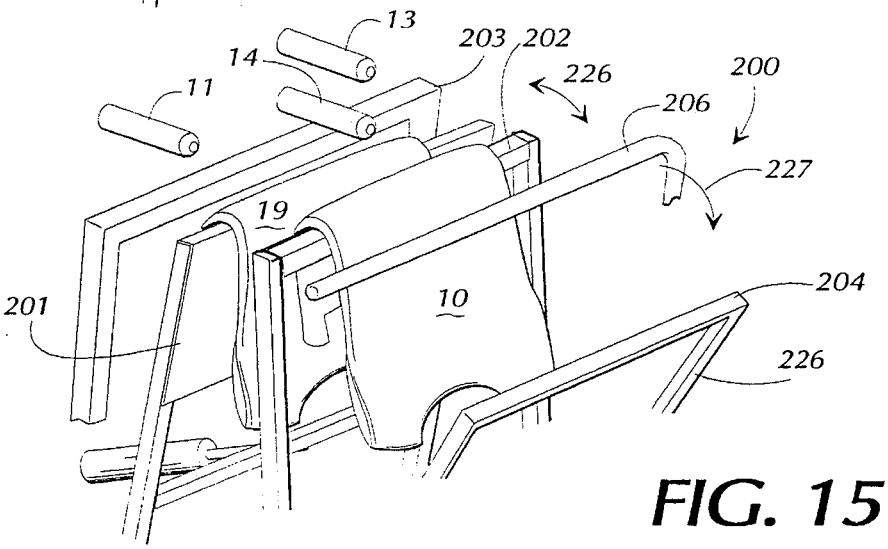
Figure 16:
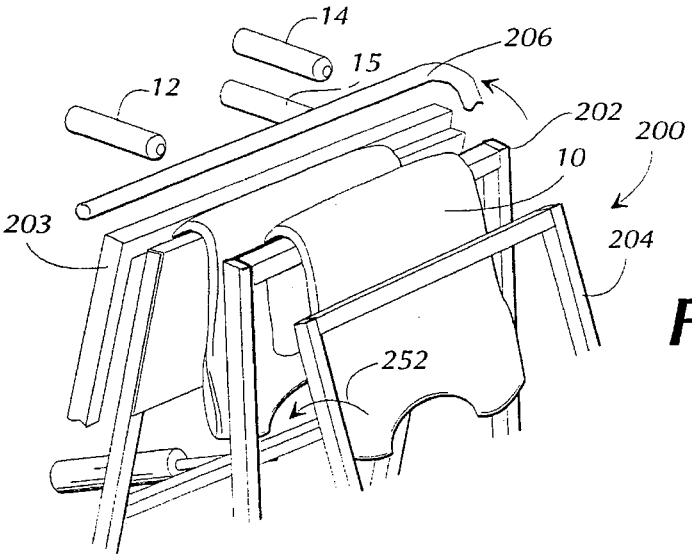

As shown in FIGS. 12 to 16, the wiper bar 206 generally is a substantially L-shaped bar or rod having a horizontally extending portion that projects forwardly that projects over and extends parallel to the upper surfaces of the upper plate 208 and upper bar 213 of the supply and accumulator frames. The wiper is pivotable in an arcuate motion across the supply and accumulator frames as shown in FIGS. 13 to 16 in order to pick up and remove a finished garment from the spindles of the waist band attachment system, causing the garment to be folded over the upper bar of the accumulator frame, stacked over previously finished garments. The wiper bar is actuated by a pneumatic cylinder that moves the wiper bar in an arcuate motion from a first position in front of the supply frame 201 and its clamp bar 203, as shown in FIG. 12, in the direction of arrows 226 to a second position over the accumulator frame 202, and (as shown in FIG. 15), and back to its initial position as shown in FIG. 16 to remove a finished garment from the waist band attachment system.

OPERATION

FIG. 17 provides a schematic illustration of the cycle time of the waist band attachment system.

Function 1: The operator folds a waist band 18 as indicated in FIGS. 1 and 2 so that its edges are in overlying alignment and inserts the waist band 18 about the spindles 11–14. When the operator loads the waist band 18 on the system, the placing of the waist band about the spindles 11–14, is detected by a band sensor 128 (FIGS. 4 and 5). This causes guide tongue assembly 95 to be moved laterally in the direction of arrow 103' into the sewing path. At the same time, the first spindle assembly 52 is moved to the left as cylinder 73 is actuated in response to the tripping of band sensor 128, and a body reflector plate 131 and a seam switch 132 are moved into the sewing path positioned above the waist band (FIG. 9A).

Once the waist band 18 has been properly placed as described, the operator then retrieves the waist edge 24 of a shirt body 19 from the stack of shirt bodies stacked on the supply frame 201 (FIGS. 12–16) and places the waist edge 24 of the shirt body 19 about the spindles 11–14 (FIG. 3).

Function 2: Once the shirt body is in place about the spindles, the operator actuates the thumbswipe switch 170 and the system begins its cycle of operation. The operator then actuates the sewing cycle of the system by passing her thumb through the thumb swipe 170 upon which the supply frame 201 is moved by its cylinder 212 toward the waist band attachment system (FIG. 13), to an out of the way position. Additionally, cylinder 91 of the second guide spindle assembly 75 is actuated, retracting its pivot rod so as to pivot arm 86 in the direction of arrow 92. As a result, spindle 14 is moved downwardly, causing the waist edges of the waist band and shirt body to be further stretched and tensioned prior to sewing. The sewing operation of the system then is commenced to form the stitching 26 until the garment parts are completed.

Functions 3, 4, 5, and 6 are then actuated simultaneously.

Function 3: Puller wheel 45 (FIG. 6) moves down and rotates against the spindle 12 to clamp the garment parts against the spindle and to pull the garment parts about the rotatable spindles 11–14.

Function 4: The garment parts are started along an initial jog to align the waist edges of the garment parts prior to sewing. Guide sensors 138 and 139 (FIG. 5) detect the position of the waist edges of the waist band and shirt body in the sewing path. The guide sensors engage the upper and lower operative edge guide units which control the position of the waist band and shirt body by moving the waist band and shirt body laterally across the sewing path. The waist edges of the waist band and shirt body thus are aligned during the initial jog and tend to move immediately adjacent the cutter of the sewing machine so as to avoid engaging the cutter during the initial jog to prevent pleating of the material. Once the initial jog is completed, control of the edge guide units is switched to the band edge and body edge sensors 112 and 129 for sewing.

Function 5: The upper operative unit 117 of guide assembly 115 controls the position of the edge of the shirt body, by the detection by body sensor 129, the waist edge of the shirt body being in or out of the sewing path, and covering and uncovering the body reflector plate 131. In response, the motor 124 is actuated to rotate star wheel 119 clockwise and counterclockwise to urge the shirt edge back to its proper position.

At the same time, band edge sensor 129 detects the position of the folded edge 21 (FIG. 2) of the waist band, which is indicative of the presence and absence of the waist edges 22 and 23 in the sewing path 16. In response, motor 124' (FIG. 9A) of the lower operative unit 116 of the edge guide assembly is actuated and rotates star wheel 119' in a reciprocable fashion causing the edges 22 and 23 (FIG. 2) of the waist band to be moved back and forth into and out of the sewing path as the folded edge 21 crosses the beam of band edge sensor 112 (FIG. 5).

Function 6: Air is supplied to the air nozzles 107 and 108 (FIG. 9A) of the decurling means 106 to remove the curl from the stretched edges of the waist band and shirt body.

Function 7: The system is allowed to operate about an initial jog for a predetermined time before sewing head 38

(FIG. 5) is actuated. This enables the waist edges of the garment parts to be moved into matched alignment before being sewn together and allows any previously curled portion of the waist edge of a shirt body to pass on through the sewing head, until the flattened portion of the waist edges pass from the edge guide assembly 115 through garment ejector 51 and to sewing head 38. At this point, presser foot 39 moves down into contact with the garment parts and the sewing needle 17 begins its sewing function.

Function 8: The system is permitted to operate for a predetermined stitch count. Once the stitch count has been achieved, an air cylinder 91 of the right spindle assembly 75 is actuated and moves spindles 13 and 14 outwardly to the right to stretch the garment parts further. This function is desirable so as to avoid the formation of a wrinkle or pleat just prior to the position of the presser foot 39 (FIG. 5). With the garment stretched further as the previously sewn portion of the garment begins its approach to the sewing needle 17, any such pleats tend to disappear.

Function 9: As the previously stitched portion of the garment (FIG. 10B) approaches the sewing head, the guide finger 136 of seam switch 132, which protrudes between the plies of material, will be engaged by the first stitches 29 (FIG. 3A), sewn in the waist band and shirt body causing the guide finger to be deflected and causing the seam switch to be activated.

Function 10: Upon engagement of the seam switch by the line of stitching of the garment, the guide tongue assembly is moved in the direction of arrow 103 out of the sewing path and body reflector plate 131 and seam switch 132 are retracted out of the path of the oncoming stitches.

Function 11: After a second predetermined stitch count has been counted by the stitch counter following the deflection of the seam switch, the ejector 51 is moved across the sewing path by the longer of its cylinders. This causes the edges of the garment parts to be moved out of the sewing path, so that the sewing needle 17 (FIG. 3B) sews off of the garment parts, and forms a thread chain 32 extending from the garment parts.

Function 12: At the same time that the ejector 51 is moved into engagement with the garment, a first air cylinder 156 (FIG. 11) of a presser foot lift cylinder assembly extends its piston rod 159 inwardly and its foot 161 engages lever 158. The lever is connected to the presser foot 39 such that as the lever is pivoted downwardly, the presser foot is raised. The downward motion of the foot 161 of the first air cylinder is limited by a stop 164 positioned adjacent the second end of the lever. As a result, the amount of movement of the lever is limited. Correspondingly, the presser foot is raised approximately ⅛" in response to the actuation of first air cylinder 156. The limited raising of the presser foot is sufficient to enable the garment to be urged outwardly from beneath the sewing head of the sewing machine, without the presser foot engaging and interfering with the continued sewing operation of the needle.

Function 13: Once the line of stitching has been sewn off of the garment, the garment is further moved along the sewing path per a predetermined stitch count or upon the further movement of the garment is halted with the point where the line of stitching 29 (FIG. 3B) moves off of the garment. At this point, the further movement of the garment along the sewing path is halted, while the sewing head of the sewing machine continues to sew and create a thread chain 32. At approximately the same time, a thread opener assembly 150 is engaged upon the detection of the third predetermined stitch count, and causes push rod 152 to be extended between the thread plates 42 and 43 of the needle thread tensioner 41 so that the tension on the needle thread 40 is released. As a result, the thread chain formed by the needle after the needle has sewn off of the garment includes needle and looper threads that are approximately equivalent in length. Having the needle and looper threads of the thread chain being approximately equivalent in length significantly reduces the possibilities of the individual threads being pulled or picked thus becoming separated so that the portion of the thread chain remaining with the garment after trimming becomes brayed with elongated pigtails that have to be further trimmed in a later processing operation.

The garment is moved to a position where the stitching exits the garment is approximately equal with the trimmer of the sewing machine and the further forward motion of the garment is halted. The thread chain then is drawn between the blades of the trimmer by a vacuum means. The thread chain is severed by the trimmer, leaving the garment with a shortened tail portion of the thread chain, approximately ¼"–½" in length, remaining connected thereto.

Function 14: Stacker 220 (FIGS. 12–16) begins its stacking function, as previously described.

Once the sewing head has sewn off of the work product, the system is de-energized, so that the spindles 11, 13 and 14 retract to their original positions close to the sewing head, garment ejector 51 retracts to its out of the way position. The accumulator frame 202 and its clamp bar 204 move as indicated by arrows 226 in FIGS. 13–14, to clamp against the trailing portion of the shirt body 19. With the shirt body clamped between the accumulator frame and its clamp bar, the wiper bar 206 begins its movement (FIG. 15) as indicated by arrow 227 toward the accumulator frame. The wiper bar lifts the shirt body and begins to move the body on to the accumulator frame while, and clamp bar 204, at the same time, begins its movement away from its clamping position, as indicated by arrow 228. This causes the shirt body 17 to be flipped over the accumulator frame.

Once the shirt body has been flipped over the accumulator frame, the clamp bat 204 returns into clamping relationship with respect to accumulator frame as indicated by arrow 229. Once clamp bar 204 has achieved clamping relationship with respect to the shirt body 17 and the accumulator frame, the clamp bar and accumulator frame pivot back to their out of the way positions as indicated in FIG. 12.

As illustrated in FIG. 4, a stationary accumulator rail 230 extends from adjacent the stacker 200 out to a lateral position beside the system. When a bunch of completed garments 10 have been accumulated on accumulator frame 202, the operator can simply slide the accumulated bunch laterally off the accumulator frame and onto the aligned accumulator rail 230, where the bunch can be retrieved by the operator and placed on a rolling trolley, etc. for subsequent processing. The system is now ready for a second cycle.

While the invention has been described as a method and apparatus that operates to connect a continuous loop waist band to the waist edge of a shirt body, it will be understood that the invention can be used to connect waist bands to the waist edge of pants, and to connect other continuous loop work products together. The terms "shirt," "garment" and "waist band" should receive a broad meaning.

It will be understood that the foregoing relates only to a preferred embodiment of the present invention, and it is anticipated that numerous changes and modifications may be made therein without departing from the spirit and scope of the invention as set forth in the following claims.

We claim:

1. A method of attaching a looped waist band to a waist edge of a shirt body comprising the steps of:

placing the waist edge of the shirt body in surrounding overlying relationship with respect to an edge of the waist band in substantially edge-to-edge alignment with the edge of the waist band, stretching the overlaid portions of the edge of the shirt body and waist band until they both are in tension, advancing the aligned edges of the waist band and the shirt body along their lengths while under tension about a sewing path through a sewing station and forming stitches in the waist band and shirt body at the aligned edges to connect them together, and as the aligned edges of the waist band and shirt body are advanced along their sewing path toward the sewing station, independently reciprocating the aligned edges of the shirt body and the waist band to maintain the edges of the waist band and shirt body in substantially edge-to-edge alignment for sewing; and further stretching the overlaid portions of the shirt body and waist band as the previously stitched portions of the waist band and shirt body approach the sewing station.

2. The method of claim 1 and wherein the step of overlaying the waist band edge of the shirt body with the waist band in edge-to-edge alignment with an edge of the waist band comprises arranging the waist band in straddling relationship about a plurality of support spindles, moving the spindles apart to partially stretch the waist band to a first position substantially matching the diameter of the waist edge of the shirt body, and telescoping the waist band edge of the shirt body about the waist band.

3. The method of claim 1 and wherein the step of stretching the overlaid portions of the waist band and shirt body until they are in tension comprises moving the spindles away from one another.

4. The method of claim 1 and further including the steps of:

moving the connected waist band and shirt body progressively out of the sewing path as the connected waist band and shirt body approach the sewing station toward the completion of a sewing cycle;

forming a thread chain extending from the connected edges of the waist band and shirt body;

as the thread chain is sewn off of the waist band and shirt body, removing tension from the needle thread so that the needle and looper threads of the thread chain are substantially equal in length; and severing the thread chain.

5. The method of claim 4 and further including the step of partially raising the presser foot at the sewing station as the connected edges of the shirt body and the waist band approach the sewing station to enable the waist band and shirt body to be moved out of the sewing path.

6. The method of claim 1 and wherein the step of reciprocating the waist edge of the shirt body and the waist band comprises engaging the shirt body with an upper wheel and engaging the waist band with a lower wheel, detecting the presence and absence of the edges of the shirt body and the said band and in response to detecting the presence and absence of the edges, rotating the upper and lower wheels to urge the edges of the shirt body and the waist band forwardly and rearwardly across the sewing path in a reciprocating motion to maintain the edges of the waist band and shirt body in alignment and in position along the sewing path.

7. The method of claim 1 and further including the steps of moving the shirt body and waist band partially along the sewing path on an initial jog of the shirt body and waist band about the sewing path with edges of the waist band and shirt body passing adjacent a cutter of the sewing station, detecting the position of the edges of the waist band and shirt body along the sewing path, and reciprocating the edges of the waist band and shirt body to align the edges and maintain the edges out of engagement with the cutter prior to the start of a sewing operation.

8. The method of claim 1 and further including the step of directing a flow of air across the edges of the shirt body and the waist band as the edges are advanced toward the sewing station to remove any curl therefrom.

9. The method of claim 1 and further including the step of detecting misfeeding of the shirt body and waist band and disengaging the sewing station upon detection of a misfed shirt body and waist band.

10. A method of attaching a looped waist band to a waist edge of a shirt body comprising the steps of:

placing the waist edge of the shirt body in surrounding overlying relationship with respect to an edge of the waist band in substantially edge-to-edge alignment with the edge of the waist band, stretching the overlaid portions of the edge of the shirt body and waist band until they both are in tension, advancing the aligned edges of the waist band and the shirt body along their lengths while under tension about a sewing path through a sewing station and forming stitches in the waist band and shirt body at the aligned edges to connect them together, and as the aligned edges of the waist band and shirt body are advanced along their sewing path toward the sewing station, reciprocating the aligned edges of the shirt body and waist band to maintain the edges in substantially edge-to-edge alignment for sewing;

counting the stitches formed by the sewing station;

detecting the presence and absence of the edges of the waist band and shirt body; and if the absence of the edges of the waist band and shirt body is not detected prior to the counting of a desired number of stitches being formed in the waist band and shirt body, terminating the operation of the sewing station.

11. The method of claim 1 and wherein the step of overlaying the waist edge of the shirt body with respect to an edge of the waist band comprises:

placing the waist band about a plurality of support spindles, with an edge of the waist band aligned with the sewing path of a sewing machine in the sewing station, moving one of the support spindles outwardly to stretch the waist band, placing the waist edge of the shirt body about the same plurality of support spindles aligned with the sewing path, and wherein the step of stretching the overlaid portions of the shirt body and the waist band comprises moving at least one spindle of the plurality of spindles.

12. A method of attaching an uninterrupted loop waist band to the waist edge of a body of an approximately tubular garment comprising the steps of:

placing the waist band about a plurality of support spindles with an edge of the waist band aligned with the sewing path of a sewing machine, stretching the waist band with the support spindles to a first stretched position with the waist band stretched to a diameter less than the diameter of the waist edge of the garment body, placing the waist edge of the garment body about the waist band with the edge of the garment body substantially matched with the edge of the waist band and aligned with the sewing path, stretching the waist band and the waist edge of the garment body with the support spindles until both the waist band and waist edge of the shirt body assume substantially the same breadth, advancing the waist band and the waist edge of the garment body while in their stretched condition along the sewing path toward the sewing needle and loopers of the sewing machine and progressively sewing the edges of the waist band and garment body together, after a portion of the sewn edges of the waist band and the garment body have reached the needle and loopers of the sewing machine, sewing off of the sewn edges of the waist band and garment body and forming a thread chain extending from the waist band and garment body edges, and as the thread chain is formed, opening tension on the thread of the needle so that the threads of the loopers and the needle that comprise the thread chain are approximately the same length.

13. The method of attaching a waist band to the waist edge of a garment body of a garment as set forth in claim 12 and further comprising the step of:

expanding the waist band and waist edge of the garment body until both the waist band and waist edge of the garment body are under tension.

14. The method of attaching a waist band to the waist edge of a garment body as claimed in claim 12 and further including the step of removing any curl in the edges of the garment body and the waist band at a position along the sewing path upstream of the sewing needle and loopers of the sewing machine as the waist band and garment body move toward the sewing needle and loopers of the sewing machine.

15. The method of attaching a waist band to the waist edge of a garment body as set forth in claim 12 and further including the steps of partially lifting the presser foot of the sewing machine as the sewn edges of the waist band and garment approach the sewing needle and loopers and progressively urging the waist band and garment body out of the sewing path and out of engagement with the needle and loopers as the needle and loopers continue to form stitches off of the garment body and waist band to form the thread chain.

16. The method of attaching a waist band to the waist edge of a garment body of a garment as set forth in claim 12 and wherein the step of initiating the sewing function of the sewing machine comprises lowering a presser foot against the waist band and shirt body.

17. The method of claim 12 and further including the step of progressively aligning the edges of the garment body and the waist band with the sewing path of the sewing machine.

18. The method of claim 17 and wherein the step of progressively aligning the edges of the garment body and the waist band comprises reciprocating the waist edge of the garment body and the waist band comprises engaging the garment body with an upper gear wheel and engaging the waist band with a lower gear wheel, detecting the presence and absence of the edges of the garment body and the said band in the sewing path, and in response to detecting the presence and absence of the edges, rotating the upper and lower gear wheels to urge the edges of the garment body and the waist band forwardly and rearwardly across the sewing path in a reciprocating motion to maintain the edges of the waist band and garment body in alignment and in position along the sewing path.

19. The method of claim 12 and further including the step of stretching the matched edges of the garment body and the waist band to tension the edges.

20. The method of claim 12 and further including the step of moving the waist band and waist edge of the garment body along an initial jog to align the edges of the waist band and garment body.

21. A system for attaching a looped waist band about the waist edge of a garment body, comprising:

a sewing machine positioned along a sewing path and having a cutter and a sewing needle and loopers for forming stitches connecting the waist band to the garment body with a supply of needle and looper threads connected thereto;

spindle means for holding and stretching the waist band and garment body with their waist edge matched as the waist band and garment body are moved along the sewing path into engagement with said needle and said loopers of said sewing machine;

drive means for moving the matched edges of the waist band and the garment body along the sewing path;

means for moving said spindle means into operative positions to stretch the waist band and garment body prior to starting a sewing operation;

edge guide means for maintaining the matched edges of the waist band and garment body in alignment with the sewing path upstream from said sewing machine and adapted to engage and move the edges across the sewing path in independent reciprocating motions in response to the detection of the presence and absence of the edges of the waist band and garment body; and guide sensors mounted along the sewing path for detecting the edges of the waist band and garment body and controlling the edge guide means as the waist band and garment body are moved about an initial jog along the sewing path to move their waist edges across the sewing path to align the edges and maintain the waist edges out of engagement with said cutter of said sewing machine prior to the start of the sewing operation.

22. The system of claim 21 and further including sensor means for controlling said edge guide means, said sensor means comprising a body sensor positioned above the sewing path in a position to detect the waist edge of the garment body, and a band edge sensor positioned below the sewing path for detecting an edge of the waist band.

23. The system of claim 22 and wherein said edge guide means comprising upper and lower operative edge guide units mounted above and below the sewing path, positioned parallel to one another, said upper and lower operative edge guide units each having a guide wheel adapted to be moved into engagement with the garment at the start of a sewing operation, and drive means responsive to one of said sensor means for rotating said guide wheel in a reciprocating fashion to urge the garment back and forth across the sewing path.

24. The system of claim 20 and further including an ejector positioned immediately upstream from said sewing machine for progressively urging the waist band and garment body laterally out of the sewing path and out of engagement with the needle and loopers of said sewing machine so that said sewing machine sews a line of stitches off of the waist band and garment body and forms a thread chain extending from the waist band and garment body, and means for opening the tension on the needle threads as the thread chain is formed by said sewing machine so that the needle and looper threads comprising the thread chain are of approximately equal length.

25. The system of claim 24 and wherein said means for opening the tension on the needle thread comprises an air cylinder mounted to said sewing machine and positioned adjacent a thread tensioner for the needle thread, and a guide pin moved by said cylinder into engagement with the thread tensioner to release the tension on the needle thread.

26. The system of claim 21 and further including decurling means positioned in the sewing path upstream of said sewing machine for removing any curl from the matched edges of the waist band and the waist edge of the garment body as the matched edges move toward said sewing machine.

27. In a sewing machine for attaching a stretchable loop waist band to the waist edge of a garment body and having a sewing needle and loopers to which a series of threads are attached for sewing the waist band and garment body together to form a finished garment, the improvement therein comprising:

spindle means for holding the edges of the waist band and garment body in a matched relationship;

drive means for moving the matched edges along a sewing path into engagement with the needle and loopers of the sewing machine;

means for progressively urging the finished garment out of the sewing path and away from engagement by the needle and loopers so that the sewing machine sews off the garment and forms a thread chain extending from the garment; and a tension opening assembly adapted to release the tension on the needle thread as the thread chain is formed by the sewing machine so that the needle and looper threads of the thread chain are of substantially equivalent lengths.

28. The sewing machine of claim 27 and wherein said tension opening assembly comprises an air cylinder mounted to said sewing machine and positioned adjacent a thread tensioner for the needle thread, and a guide pin moved by said cylinder into engagement with a thread tensioner for the needle thread to release the tension on the needle thread.

29. The system of claim 27 and further including decurling means positioned in the sewing path upstream of said sewing machine for removing any curl from the matched edges of the waist band and the waist edge of the garment body as the matched edges move toward said sewing machine.

30. The attachment for a sewing machine as set forth in claim 29 and further including means for moving said spindle means to stretch the waist band and the waist edge of the garment body to substantially the same breadth as the matched edges are decurled and sewn together.

31. A method of attaching the waist edges of a loop waist band to the wrist edge of a garment body, comprising the steps of:

moving the waist band and garment body along a sewing path toward a sewing needle of a sewing machine with the waist edges of the waist band and garment body substantially matched;

sewing the waist edge of the waist band to the waist edge of the garment body;

as the waist edges of the waist band and garment body are moved toward the sewing needle, independently engaging and reciprocating the waist band and garment body across the sewing path with star wheels of upper and lower edge guide units to maintain the waist edges of the waist band and garment body in a substantially matched alignment; and as seams in the waist band and garment body engage and pass by the star wheels, moving the star wheels in the direction of the sewing path to enable the seams to pass by the star wheels without disrupting the movement of the waist band and garment body along the sewing path.

32. The method of claim 31 and further including the step of stretching the matched waist edges of the waist band and garment body until they both are in tension.

33. The method of claim 31 and further including the step of placing the waist edge of the garment body in surrounding, overlying relation and in substantially edge-to-edge alignment with respect to the waist edge of the waist band.

34. The method of claim 32 and further including the steps of further stretching the matched waist edges of the waist band and garment body as the sewn portion of the waist band and garment body approaching the sewing needle to remove any wrinkles in the waist band and garment body prior to reaching the sewing needle.

35. The method of claim 31 and wherein the step of reciprocating the waist edge of the garment body and the waist band comprises detecting the presence and absence of the edges of the shirt body and the waist band as the shirt body and waist band move along the sewing path, and in response to detecting the presence and absence of the edges, rotating the upper and lower star wheels in independent reciprocating motions to urge the edges of the shirt body and the waist band independently across the sewing path to maintain the edges of the waist band and shirt body in position along the sewing path.

36. A system for attaching the waist edges of a waist band and a garment body, comprising:

a sewing machine positioned along a sewing path of the waist band and garment body and having a sewing needle and loopers for connecting the waist edge of the waist band to the waist edge of the garment body;

drive means for moving the waist edges of the waist band and garment body along the sewing path;

edge guide means for maintaining the edges of the waist band and garment body in substantially matched alignment and in alignment with the sewing path upstream from the sewing needle, said edge guide means including star wheels adapted to engage and move the waist edges of the waist band and garment body laterally in independent reciprocating motions across the sewing path to maintain the waist edges in substantially matched alignment; and means for biasing said star wheels, positioned adjacent said star wheels to enable said star wheels to move along the sewing path as seams in the waist band and garment body engage and pass thereunder to prevent said star wheels binding in the waist band and garment body and disrupting a sewing operation.

37. The system of claim 36 and further including sensor means for controlling said edge guide means, said sensor means comprising a body sensor positioned above the sewing path in a position to detect the waist edge of the garment body, and a band edge sensor positioned below the sewing path for detecting the edge of the waist band.

38. The system of claim 37 and wherein said edge guide means comprises upper and lower operative edge guide units mounted above and below the sewing path, positioned parallel to one another, and to which said star wheels are mounted, said edge guide units adapted to move said star wheels into engagement with the garment at the start of a sewing operation, and drive means responsive to one of said sensor means for rotating said guide wheel in a reciprocating fashion to urge the garment back and forth across the sewing path.

39. The system of claim 36 wherein said sewing machine includes a cutter and further including guide sensors mounted along the sewing path for detecting the edges of the waist band and garment body and controlling the edge guide means as the waist band and garment body are moved about an initial jog along the sewing path to move the edges across the sewing path to align the edges and maintain the edges out of engagement with said cutter of said sewing machine prior to the start of the sewing operation.

40. A system for attaching the waist edges of a waist band and a garment body, comprising:

a sewing machine positioned along a sewing path of the waist band and garment body and having a sewing needle and loopers for connecting the waist edge of the waist band to the waist edge of the garment body;

drive means for moving the waist edge of the waist band and garment body along the sewing path;

edge guide means for maintaining the edges of the waist band and garment body in substantially matched alignment and in alignment with the sewing path upstream from the sewing needle, said edge guide means including star wheels adapted to engage and move the waist edge of the waist band and garment body laterally in independent reciprocating motions across the sewing path to maintain the waist edges in substantially matched alignment;

means for biasing said star wheels, positioned adjacent said star wheels to enable said star wheels to move as seams in the waist band and garment body pass thereunder to prevent said star wheels binding in the waist band and garment body and disrupting a sewing operation;

an ejector positioned immediately upstream from said sewing machine for progressively urging the waist band and garment body laterally out of the sewing path and out of engagement with the sewing needle and loopers of said sewing machine so that the sewing needle sews a line of stitches off of the waist band and garment body and forms a thread chain extending from the waist band and garment body, and means for opening the tension on the needle threads of the thread chain as the thread chain is formed by said sewing machine so that the needle and looper threads comprising the thread chain are of approximately equal length.

41. The system of claim 40 and wherein said means for opening the tension on the needle thread comprises an air cylinder mounted to said sewing machine and positioned adjacent a thread tensioner for the needle thread, and a guide pin moved by said cylinder into engagement with the thread tensioner to release the tension on the needle thread.

42. The system of claim 36 and further including spindle means for holding and stretching waist band and garment body with their waist edges substantially matched as the waist band and garment body are moved along the sewing paths toward the sewing needle.

* * * * *